US005911519A

United States Patent [19]

Eutebach

[11] Patent Number: 5,911,519

[45] Date of Patent: Jun. 15, 1999

[54] SHOWER PARTITIONING

[76] Inventor: Peter A. Eutebach, Obernbergstrasse 16a, 32105, Bad Salzuflen, Germany

[21] Appl. No.: 08/997,159

[22] Filed: Dec. 23, 1997

[30] Foreign Application Priority Data

Sep. 24, 1997 [DE] Germany ..... 197 42 139

[51] Int. Cl.[6] ..... A47K 3/22

[52] U.S. Cl. ..... 4/607; 4/610

[58] Field of Search ..... 4/607, 596, 597, 4/604, 605, 610, 557; 49/409, 404, 380

[56] References Cited

U.S. PATENT DOCUMENTS 4,611,436 9/1986 Williams ..... 4/607
4,785,485 11/1988 Etesam ..... 4/607
5,079,872 1/1992 Short ..... 4/607

FOREIGN PATENT DOCUMENTS

WO94/24917 11/1994 WIPO .

*Primary Examiner*—David J. Walczak
*Attorney, Agent, or Firm*—Knobbe, Martens, Olson & Bear, LLP

[57] ABSTRACT

A shower partitioning includes a vertically supported, frameless first partition pane which has slidably held thereon a second partition pane. The second partition pane is in a plane which is parallel to a plane of the first partition pane. The first partition pane supports at least one horizontal carrier in a longitudinally slidable mannerby means of at least two guide rolls. The horizontal carrier is secured to the second partition pane in a plane parallel to the second partition pane and spaced apart from the second partition pane.

26 Claims, 21 Drawing Sheets

SHOWER PARTITIONING

FIELD OF THE INVENTION

The present invention relates to a shower partitioning comprising at least one vertically supported, frameless first partition pane which has slidably held thereon a second partition pane in a plane parallel to the plane of the first partition pane.

BACKGROUND OF THE INVENTION

Shower partitionings with slide doors are already known from the prior art with the most different designs. First of all, there are many constructions in the case of which the partition panes are received in a frame and the individual frames are guided slidably or telescopically in one another. Such constructions cannot be used for frameless partition panes and have the additional drawback that the frames are very thick and solid and do not satisfy the high demands made on their optical appearance.

WO 94/24917 already discloses a shower partitioning in which the individual partition panes are supported on a telescopic arm. On the one hand, such a telescopic arm is characterized by a large constructional volume and a complicated structure; on the other hand, the construction used is prone to failure and can get soiled easily. Such a construction has not proved to be successful for all of these reasons and has consequently not been accepted on the market.

SUMMARY OF THE INVENTION

It is the object of the present invention to provide a shower partitioning of the above-mentioned type which is of a simple construction and can easily be manufactured and operated and nevertheless ensures a reliable slidable support of the second partition pane in such a manner that the shower partitioning also satisfies the highest demands made on its optical appearance.

This object is achieved according to the invention by the features of the main claim; the subclaims illustrate further advantageous embodiments.

Hence, within the scope of the invention, at least one horizontal carrier which is supported on the first partition pane in a longitudinally slidable manner by means of at least two guide rolls is secured to the second partition pane in a plane parallel to the second partition pane and spaced apart from the second partition pane.

The shower partitioning according to the invention is characterized by a number of considerable advantages. A very simple construction of the shower partitioning is ensured by the use of at least one horizontal carrier which is operably supported on only two guide rolls. Complicated additional components which get easily soiled or are prone to failure are not needed for receiving the support force of the second partition pane and for ensuring the slidability thereof. Thus, the horizontal carrier is slidably supported in a very simple manner; no telescopic components are needed, the whole construction is very simple and robust. A statically determined, exact guidance of the carriers, which is also suited for supporting heavy partition panes, in particular partition panes of glass, is obtained thanks to the two guide rolls which are preferably rotatable about two parallel, horizontal axes and spaced apart horizontally in an advantageous design.

In a particularly advantageous embodiment of the invention, at least one guide roll is vertically adjustable.

Such a design is an alternative to a very precise manufacture of the two guide rolls and the support thereof. As a result of the adjustable construction, slight mounting inaccuracies can be compensated for and/or a distortation or deformation caused by a great weight of the partition pane.

The vertically adjustable guide roll can, for example, be adjusted by means of an eccentric mechanism. However, it is also possible to implement adjustability, which as a rule is only possible in the vertical direction, by means of a simple adjusting or slide mechanism, for instance by means of screws.

The guide rolls are preferably provided with means for laterally guiding the carrier, so that additional measures can be dispensed with. For instance, the carrier may be guided by means of concave guide rolls. However, it is also possible to provide lateral shoulders, or the like, on the guide rolls to prevent a lateral displacement of the carrier.

The carrier is preferably provided with a rectangular cross-section. In this embodiment, the first guide roll which faces the second partition pane is arranged below the carrier, whereas the second guide roll is supported at a horizontal distance thereto above the carrier. The carrier is thereby held in a statically defined, slidable manner. It may be advantageous in conjunction with the concave rolls when the upper and the lower sides of the carrier, which form each a running surface, are made convex.

The described support of the carrier by means of two rolls is very well suited for receiving downwardly acting forces which are applied by the second partition pane. To prevent a lifting of the second partition pane and thus of the carrier, a third guide roll may be provided which, for instance, is supported above the carrier. However, it is also possible to arrange the third guide roll below the carrier. Hence, this third guide roll prevents the carrier from being lifted from the two other guide rolls. Hence, a pure safety measure is here concerned.

In an alternative embodiment of the present invention, it may be advantageous when the carrier comprises a substantially C-shaped cross-section, with the first and the second guide rolls being arranged in the interior of the carrier. These guide rolls are also spaced apart from one another horizontally and arranged at different vertical levels, so that the guide rolls are freely rotatable on the one hand and can respectively receive an upwardly or downwardly oriented force on the other hand.

In this variant of an embodiment, it may also be advantageous to arrange a third guide roll in the interior of the carrier, the third guide roll additionally counteracting a lifting of the second partition pane.

To prevent the second partition pane from tilting and to support the second partition pane in an exact manner, it may be of advantage when the second partition pane is slidably supported on the first partition pane by means of two parallel, spaced-apart carriers and associated guide rolls.

As an alternative to the use of two carriers that are in parallel with each other and have each their own guide rolls, it may be advantageous to use only one carrier which has an increased height. As a result, the vertical distance of the upper and lower guide rolls is increased, resulting in an improved tilting stability. Such a design can be achieved by the measure that the two carriers which are parallel to each other form a closed frame. However, it is also possible to use only a single, plate-shaped carrier. Such a plate-shaped carrier or the closed frame may advantageously be provided with a grip portion so that an actuating handle need not additionally be provided on the second partition pane.

Furthermore, the above-described variant of an embodiment in which the two carriers are either connected to a closed frame or form a plate-shaped integral element, has the great advantage that all guide rolls can be supported on a joint carrier plate. Hence, the guide rolls can be assigned and assembled in an exact manner prior to the mounting of the carrier plate on the partition pane. Hence, assembly work is simplified considerably; to be more specific, a very small play of the guide rolls is adjustable, resulting in a precise run of the carrier.

According to the invention, it goes without saying that a third partition pane can analogously be supported on the second partition pane by means of further carriers and guide rolls.

To prevent unintended withdrawal of the second partition pane or of the horizontal carrier, it may be advantageous that a stopper or abutment is secured to the free end of the carrier. Said stopper or abutment may be of a detachable type for removing the second partition pane for cleaning or mounting purposes.

To avoid injuries, it may be advantageous when the rolls are covered by means of at least one protective pane.

According to the invention, the carrier may additionally be provided with marks to define, for instance, an extended end position or a retracted end position of the second partition pane and to indicate such a position to a user.

According to the invention, the first partition pane can be secured to a wall of a building in such a manner that it is openable either at one side or can be pivoted at both sides, in the manner of a double-acting door. However, it is also possible to mount the first partition pane in a fixed, i.e., unmovable manner. The shower partitioning of the present invention is suited not only for shower trays, but also for bathtubs, or the like. Furthermore, the invention can also be used for other partition or door elements which are not specifically assigned to showers, for example room dividers, such as changing cubicles in medical sectors, or the like.

Thanks to the way of supporting the horizontal carriers, fats or lubricants need not be used. Rather, the carrier can be guided on the guide rolls in a dry state. Hence, the invention can also be used in an especially advantageous manner in surroundings that make high demands on hygiene, for instance in hospitals.

BRIEF DESCRIPTION OF THE DRAWINGS

The invention shall now be described with reference to embodiments taken in conjunction with the drawing, in which.

DETAILED DESCRIPTION OF THE INVENTION

Figure 1:
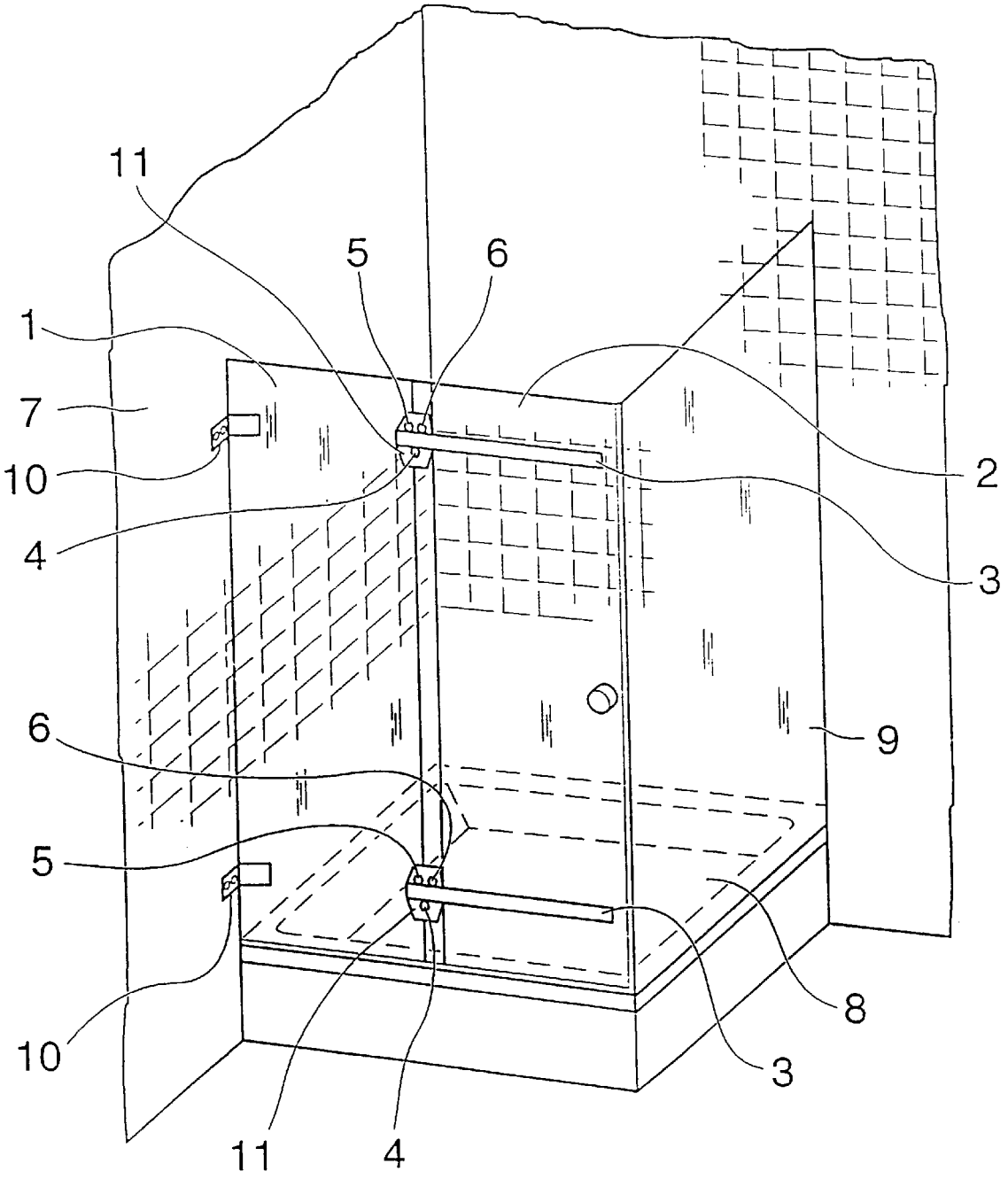
FIG. 1 is a schematic perspective view of a corner-mounted shower using the shower partitioning of the invention.
Figure 2:
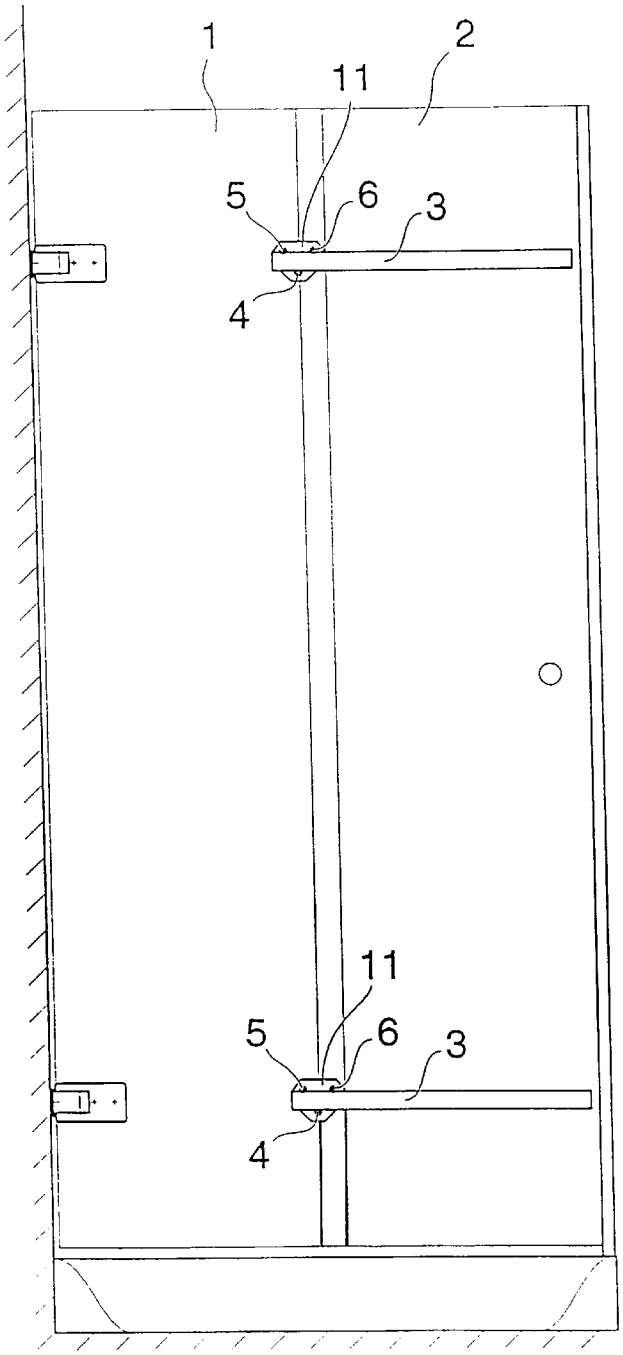
FIG. 2 is a side view, simplified illustration, of the assembly shown in FIG. 1, in the closed state of the second partition pane.
Figure 3:
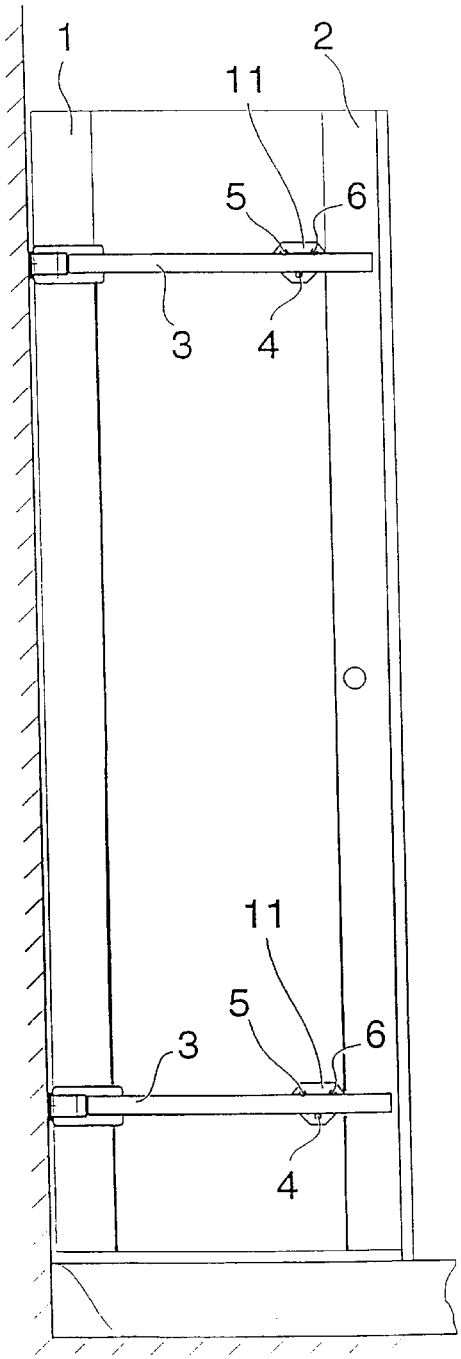
FIG. 3 is a side view analogous to FIG. 2, in the opened state of the second partition pane.

FIG. 1 is a schematic illustration of a corner-mounted shower comprising a shower tray 8 which is defined by tiled walls 7 of a building. One side of the corner shower is formed by a fixed partition wall 9 while at the other side a first partition pane 1 is supported by means of hinged joints 10. The first partition pane can be opened inwards or outwards to permit access to the shower.

An upper carrier plate 11 and a lower carrier plate 11 are each secured to the first partition pane 1, preferably by means of a screwing. As is, for example, shown in FIGS. 6 and 7, the carrier plate 11 may be screwed by means of a counter-plate 12.

A first guide roll 4 and a second guide roll 5 are supported on the carrier plate 11. A third guide roll 6 may additionally be provided. A horizontal carrier 3 is slidably guided between the guide rolls 4 and 5 and has a free end that has arranged thereat a yoke or bearing block 13 which, in turn, is connected to a second partition pane 2, preferably by means of a screwing with the aid of a counter-pressure plate to form a stopper detachably secured to the free end of the carrier 3.

The first and second partition panes are shaped in the form of frameless glass panes.

As becomes, for example, apparent from FIGS. 1 to 4, the second partition pane 2 which is arranged on the inside of the first partition pane (relative to the shower room) can be slid in parallel to the first pane. Since the horizontal carrier 3 is arranged in parallel with the second partition pane 2 and thus with the first partition pane 1, it is possible to arrange the carrier outside of the first partition pane (relative to the shower room), so that both the carrier and the guide rolls are not subjected to splash water. Cleaning of the shower partitioning is thereby facilitated quite considerably.

Figure 6:
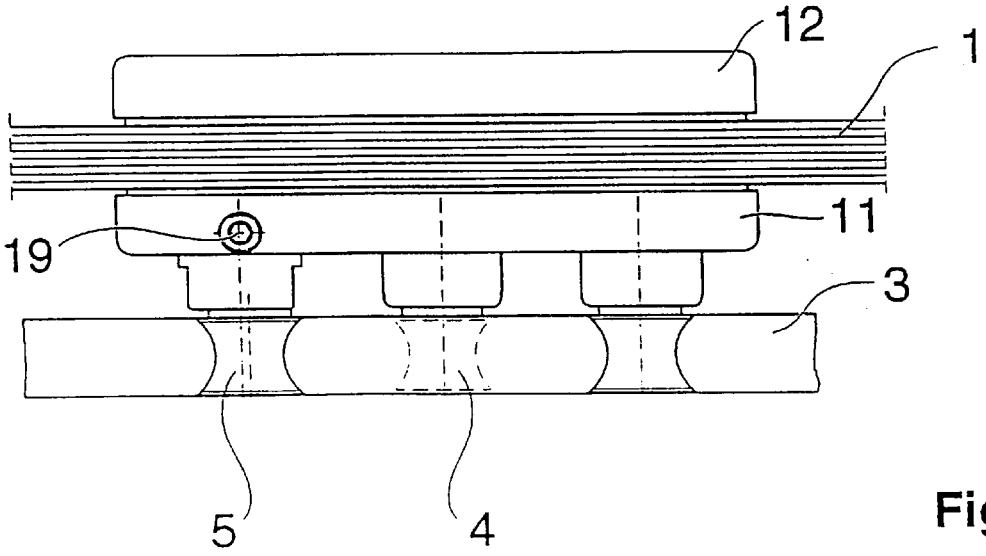
FIG. 6 is a top view on the arrangement shown in FIG. 5.
Figure 7:
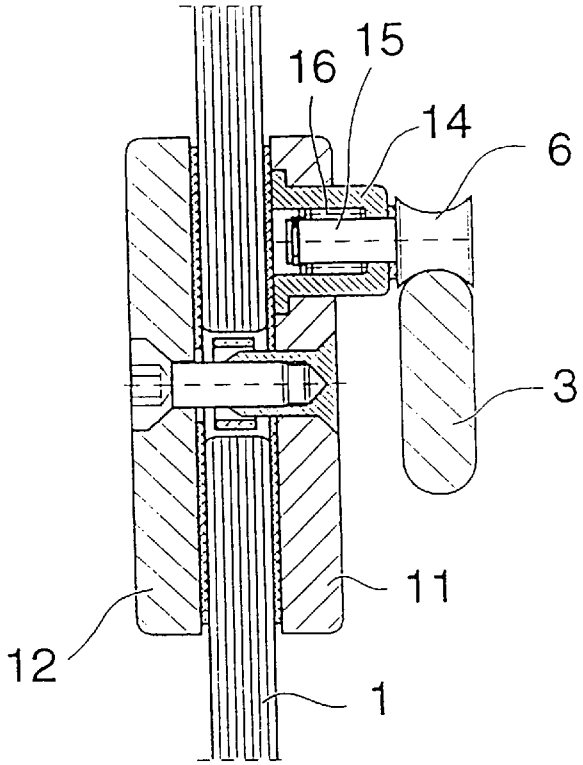
FIG. 7 is a side view taken along section line A–B of FIG. 5.
Figure 8:
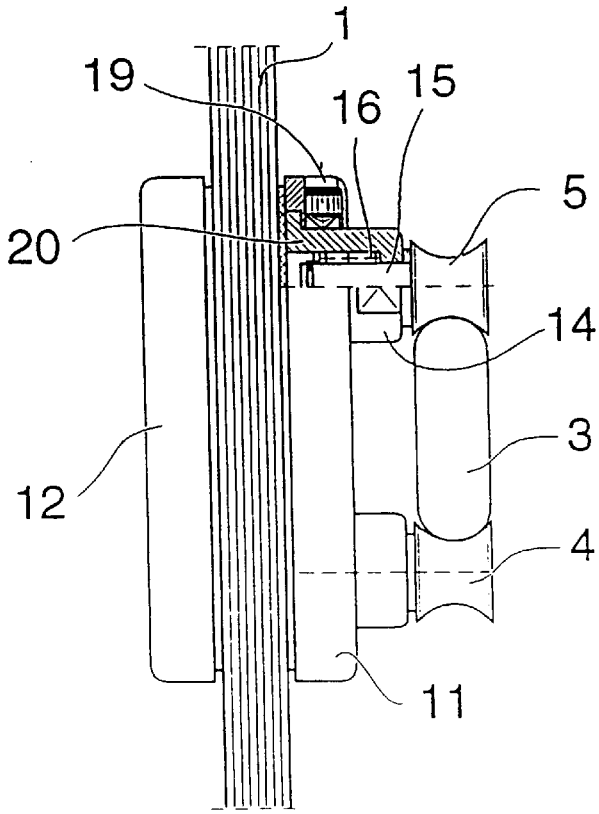
FIG. 8 is a front view (in partial section) of the guide roll shown in FIG. 5.
Figure 9:
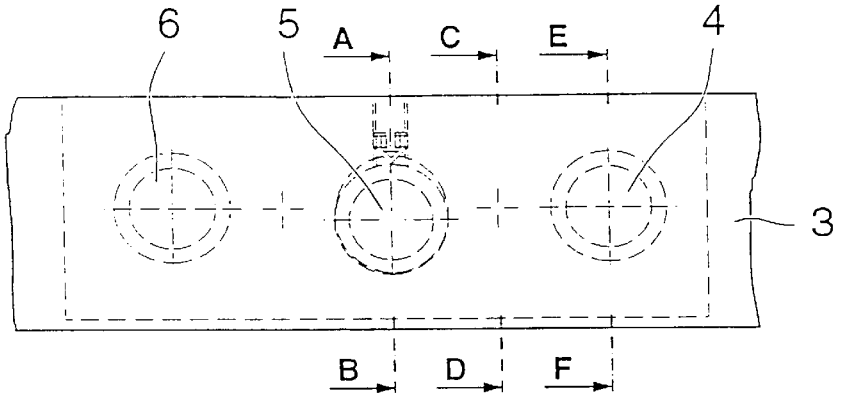
FIG. 9 is a side view of a further embodiment of the invention.
Figure 10:
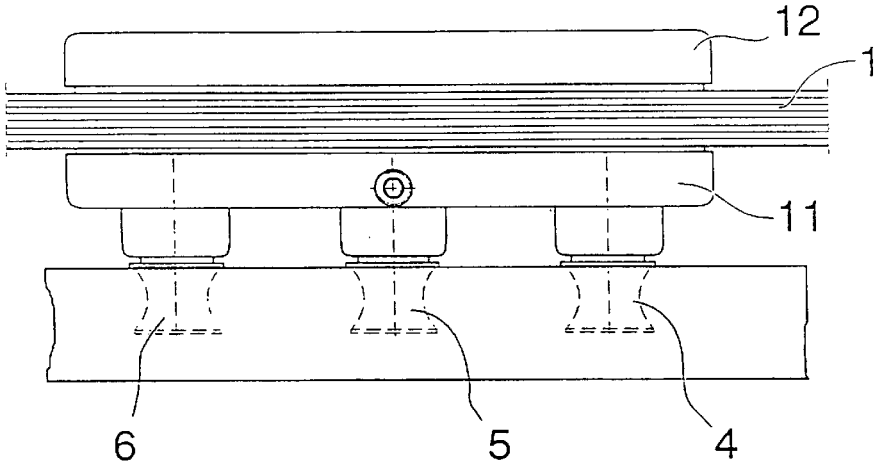
FIG. 10 is a top view on the arrangement shown in FIG. 9.
Figure 15:
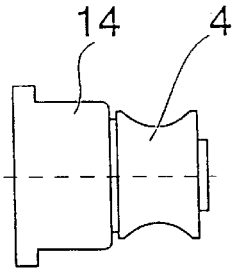
FIG. 15 is a side view of a further embodiment of a guide roll of the invention.
Figure 16:
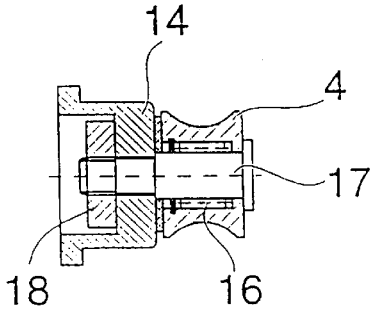
FIG. 16 is a sectional view of the arrangement shown in FIG. 15.

FIGS. 6 to 8 show a first embodiment in which the horizontal carrier 3 has a substantially rectangular cross-section with rounded upper and lower guide surfaces. Each of the guide rolls 4, 5 and 6 has a concave shape, so that a lateral guidance of the horizontal carrier is ensured. As becomes, for example, apparent from FIG. 7, a shaft 15 which is rotatably supported in a bearing housing 14 by means of a bearing 16 (needle bearing) is integrally secured to rolls 4, 5 and 6. The bearing housing 14 is passed through a recess of the carrier plate 11 and is held by the screwing of the carrier plate 11. A variant with respect to the embodiment shown in FIG. 7 follows from FIGS. 15 and 16. In these figures, the guide roll is directly supported on a fixed axle 17 by means of the bearing 16. The axle 17 is screwed by means of a nut 18 to the bearing housing 14 (see also FIG. 15).

Figure 5:
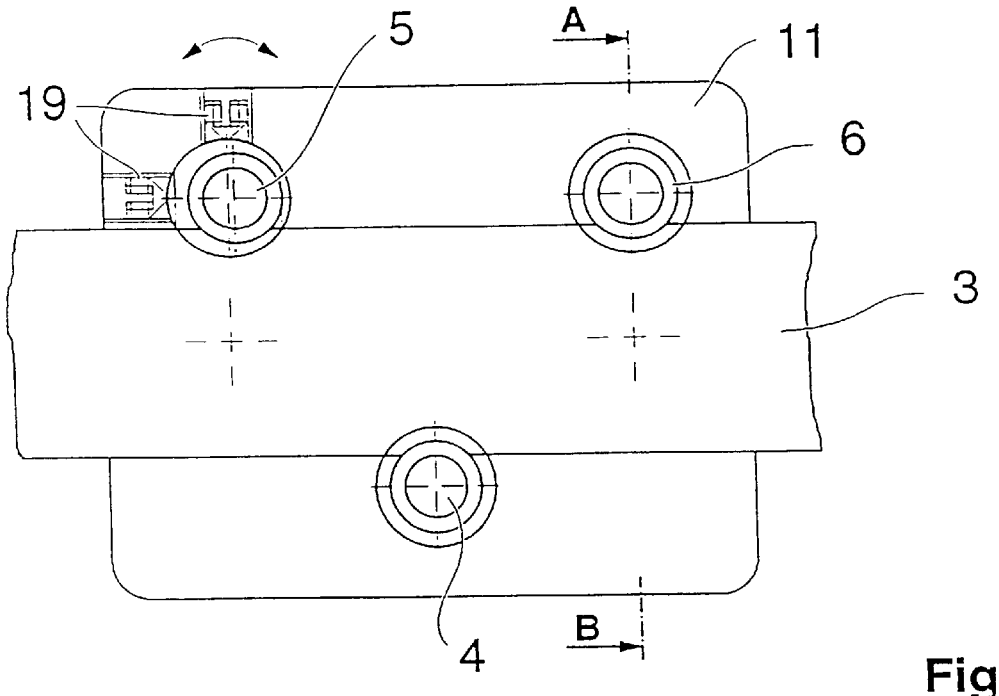
FIG. 5 is an enlarged view of the supporting area of the carrier of the invention.

Like FIGS. 5 and 6, FIG. 8 is a part section showing the adjustable arrangement of the second guide roll 5. The bearing housing 14 is here provided with an eccentric flange 20 which is rotatable in a recess of the carrier plate 11 (see, in particular, FIGS. 5 and 6). The respective eccentric position of the bearing housing 14 is fixed by means of screws 19. It is thus possible to adjust the guide roll 5 to make sure that the carrier 3 is guided without any play.

Figure 11:
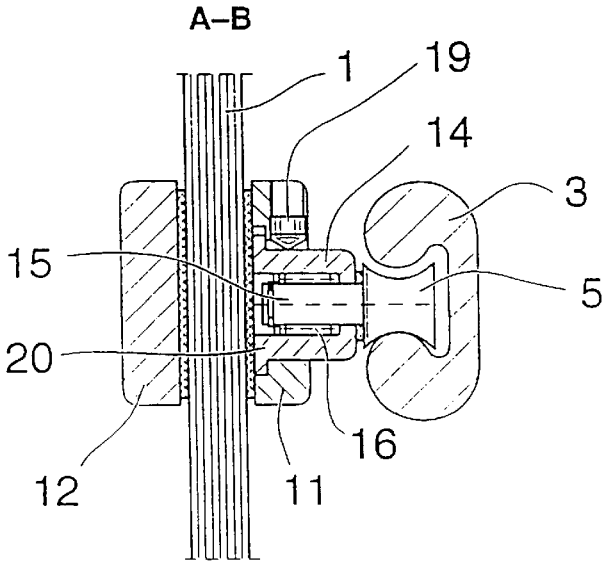
FIG. 11 is a sectional view taken along section line A–B of FIG. 9.
Figure 12:
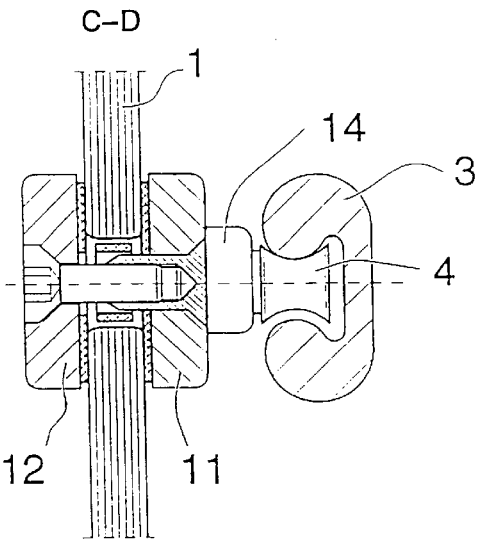
FIG. 12 is a sectional view taken along section line C–D of FIG. 9.
Figure 17:
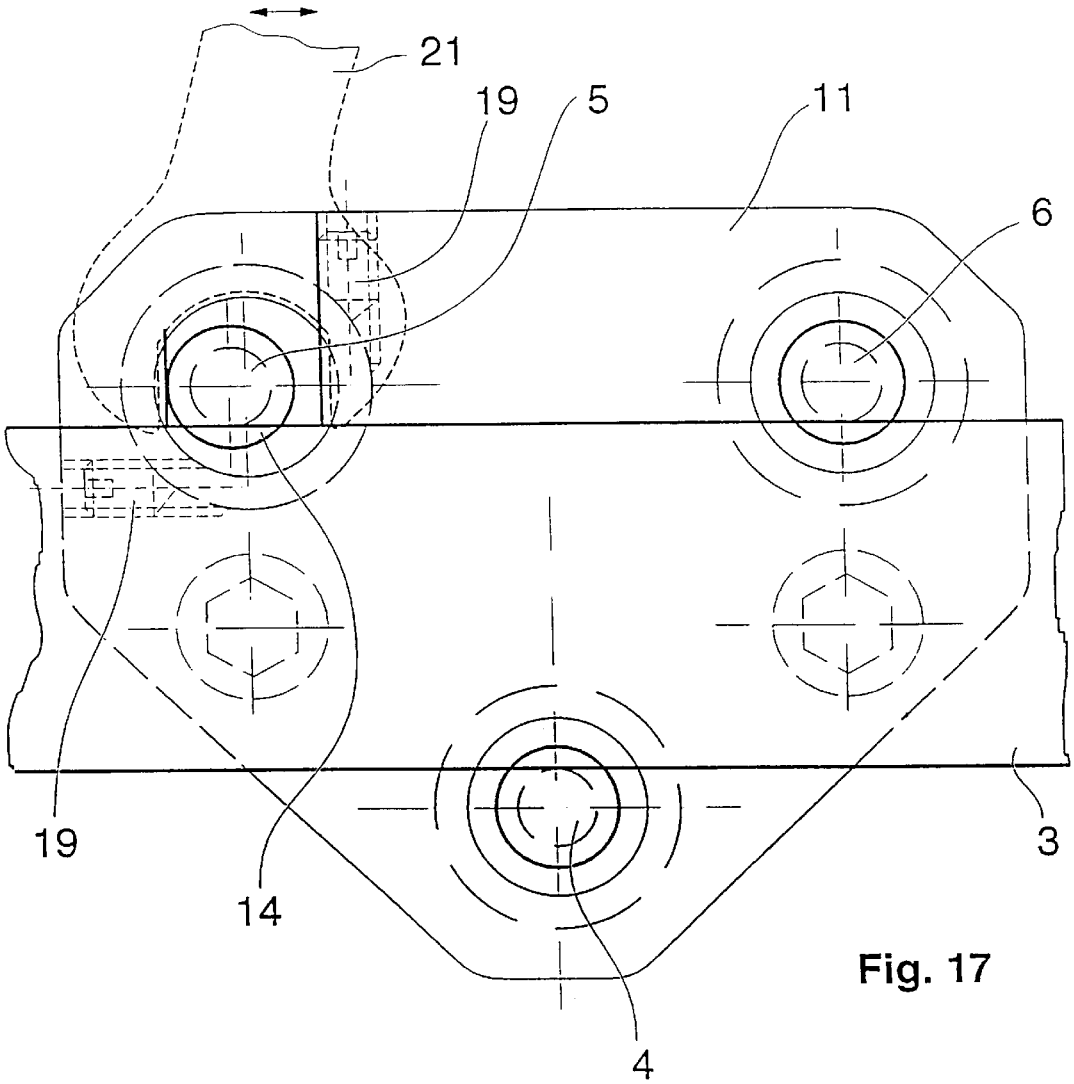
FIG. 17 is an enlarged detail view of the adjusting mechanism of the guide roll, similar to the view shown in FIG. 5.

FIGS. 9 to 14 show an alternative embodiment of the carrier of the invention and of the associated guide rolls. In this embodiment, the horizontal carrier 3 has a C-shaped cross-section (see, in particular FIGS. 11 to 14), in the interior of which the guide rolls 4, 5, and 6 are arranged. In this embodiment, the inner edges of the carrier 3 are ball-shaped, so that lateral guidance is ensured by means of the concave guide rolls 4, 5 and 6. In this embodiment, too, the guide rolls are supported on the carrier plate 11 by means of a bearing housing 14. The adjustability of the second guide roll 5, as shown in FIG. 11, is by analogy with the adjustability shown in FIG. 8; in this case an eccentric flange 20 is also provided for. As shown by the illustration of FIG. 17, the eccentric flange may be provided with lateral contact surfaces for an open-end wrench 21, so that the bearing housing 14 can be rotated easily after screws 19 have been unscrewed to ensure an adjustment of the second guide roll 5.

Figure 18:
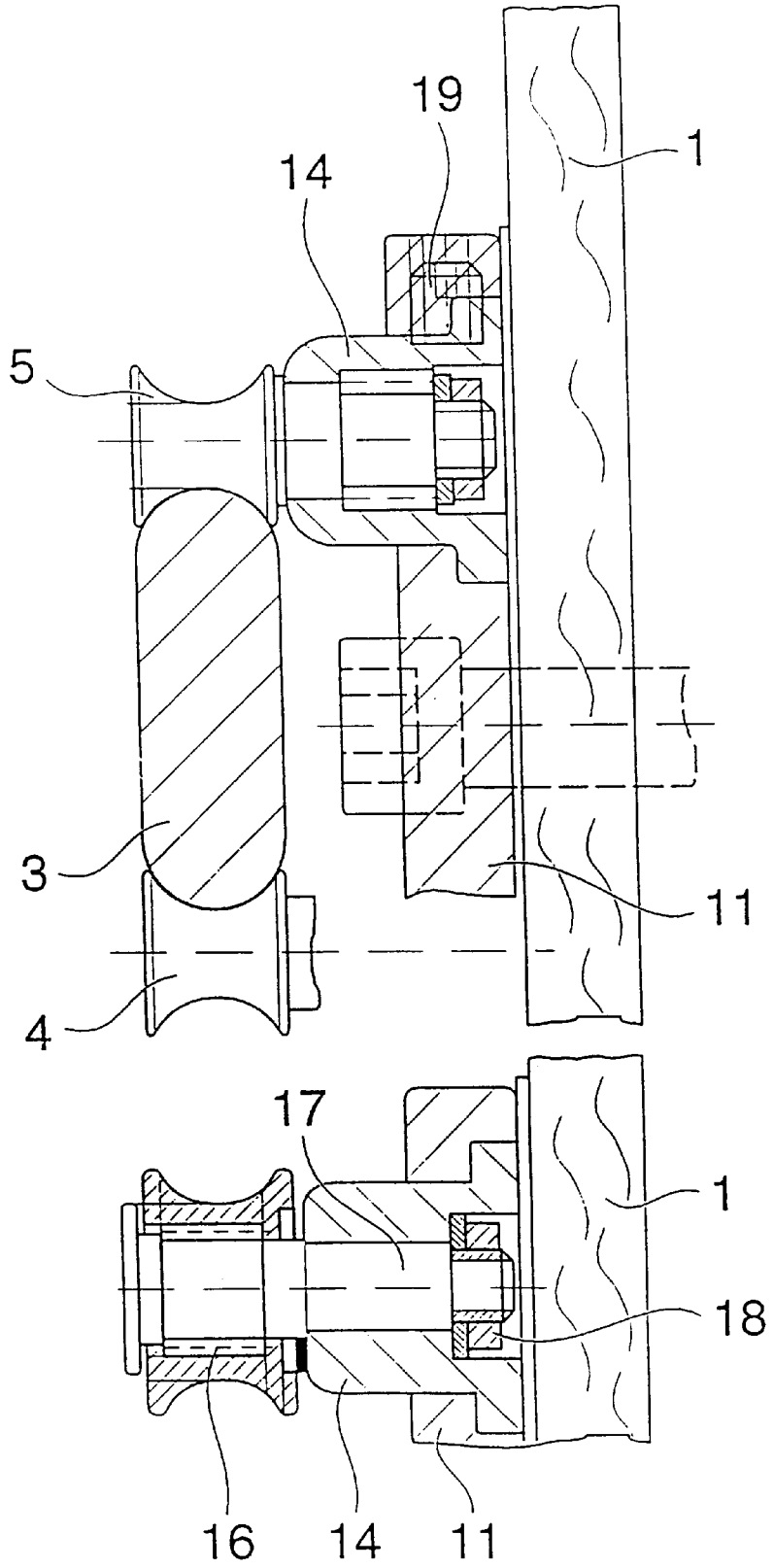
FIG. 18 is a side view, partly in section, of an eccentric adjusting mechanism for the guide roll.

FIG. 18 once again illustrates the eccentric adjustability of the guide roll 5.

Figure 19:
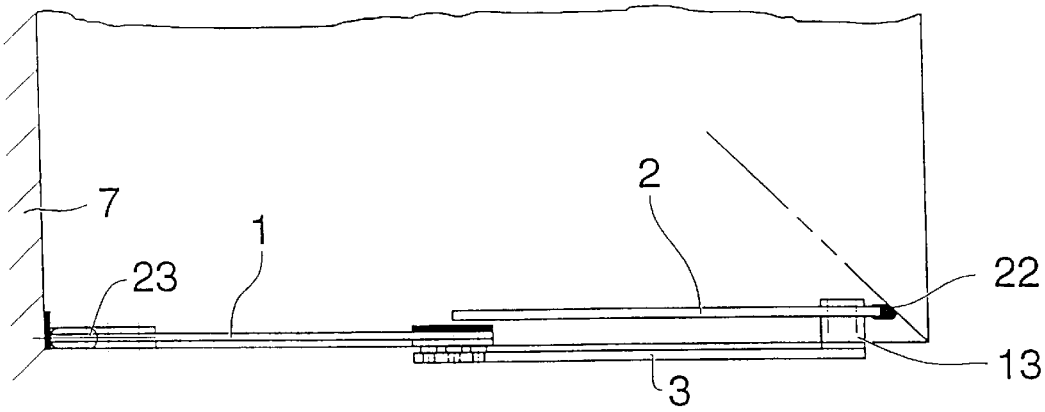
FIG. 19 is a simplified top view on an embodiment of the shower partitioning of the invention in the fully closed state.
Figure 20:
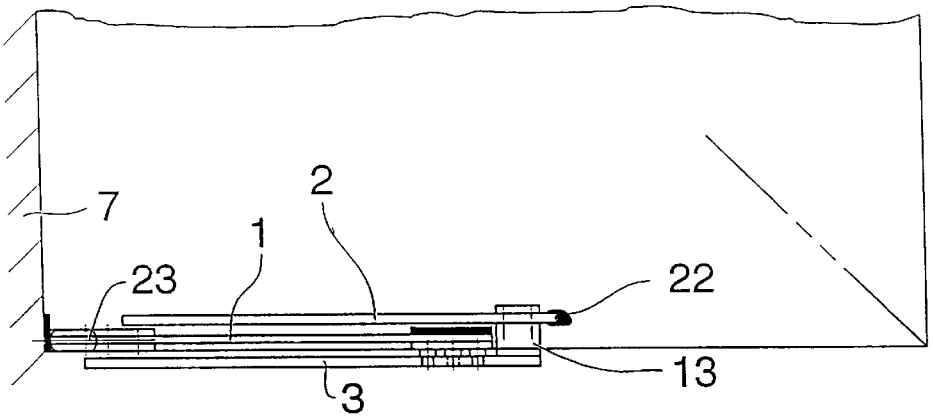
FIG. 20 is a top view, similar to FIG. 19, in a partly opened state.
Figure 21:
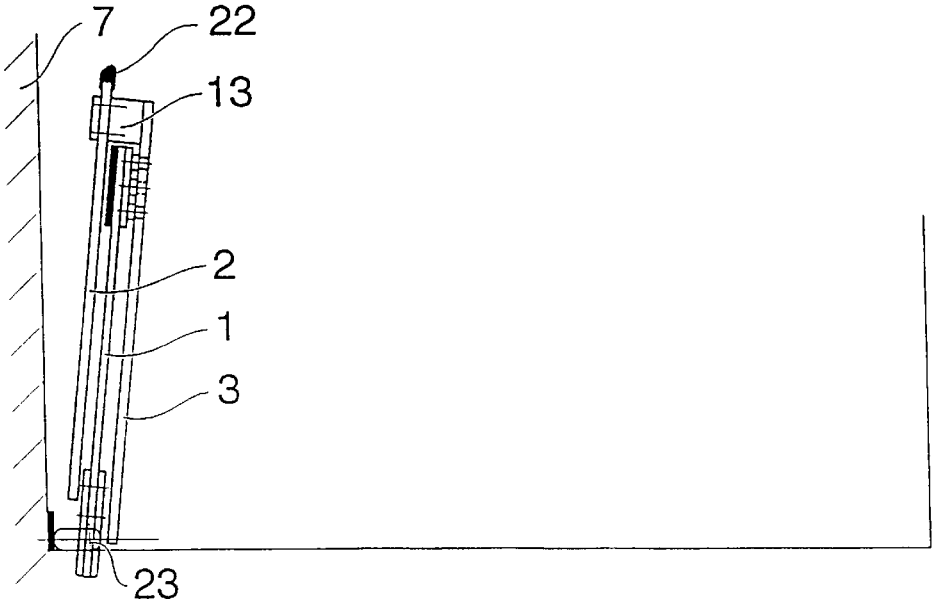
FIG. 21 is a top view, similar to FIG. 20, in a completely opened state, with the shower partitioning being pivoted towards the shower room.
Figure 22:
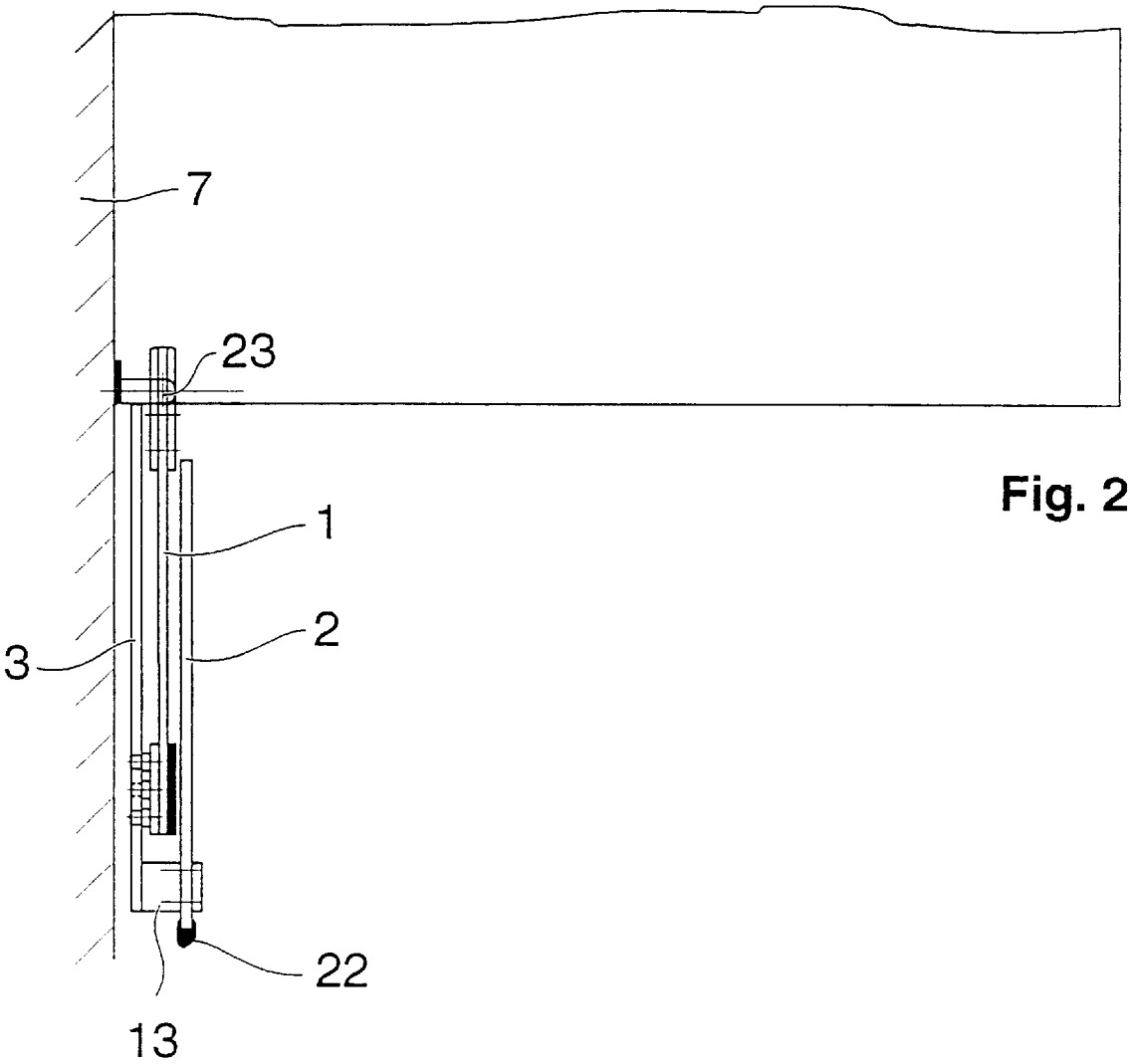
FIG. 22 is a view analogous to FIG. 21, with the shower partitioning being pivoted away from the shower room.

FIGS. 19 to 22 are a top view on a simplified embodiment in which the shower partitioning of the invention is, for instance, installed as a bathtub partitioning. The opening process becomes successively apparent from FIGS. 19 to 22. FIGS. 19 shows the closed state. A seal 22 at the front side rests either on a wall of a building or on an additional partition wall, or the like. The state shown in FIG. 20 is reached by sliding the second partition pane 2 back. Subsequently, the first partition pane can be pivoted together with the second partition pane about an axis 23, either to the outside or to the inside.

Figure 23:
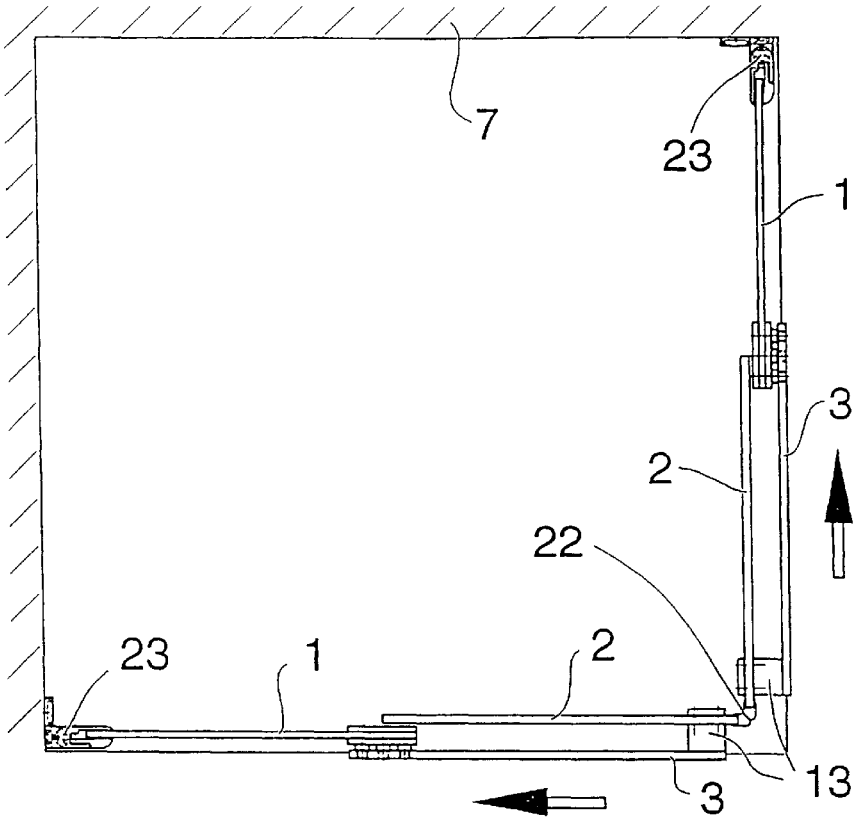
FIG. 23 is a simplified top view on an embodiment of the shower partitioning of the invention (in the closed state) in the case of a corner-mounted shower.
Figure 24:
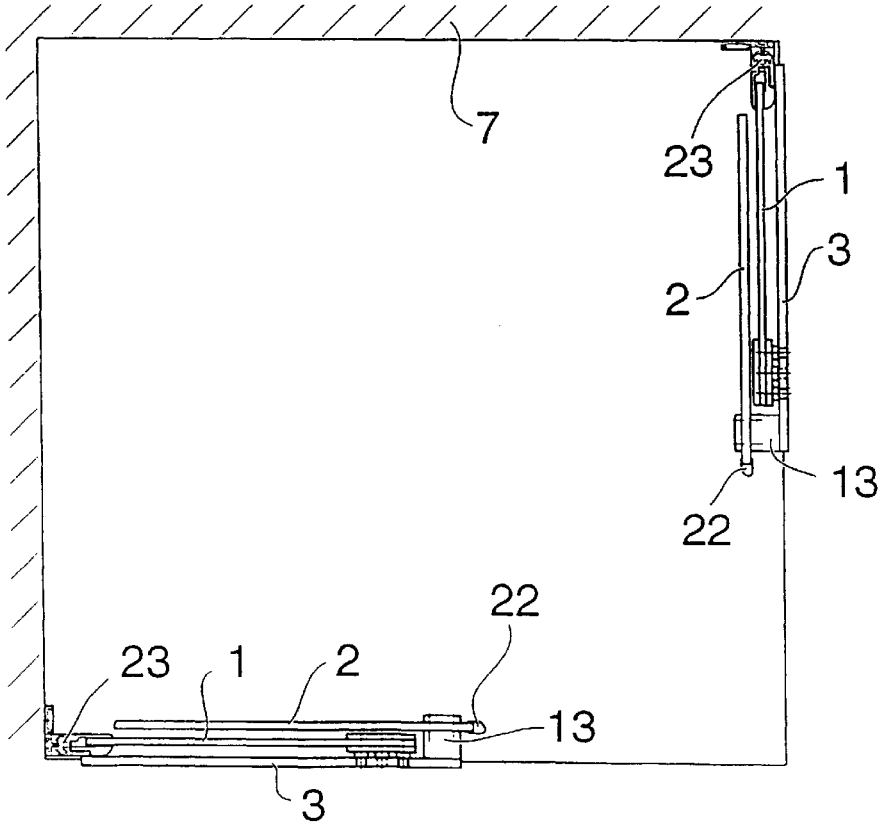
FIG. 24 is a top view, analogous to FIG. 23, in a partly opened state.
Figure 25:
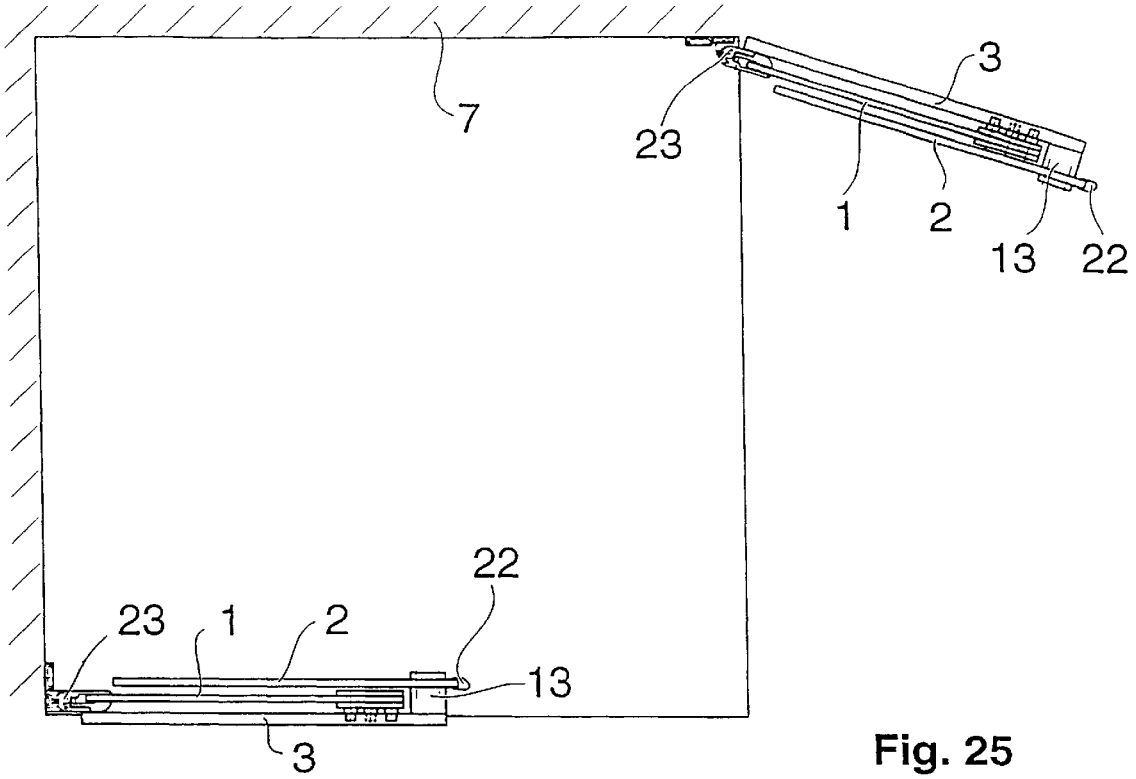
FIG. 25 is a top view, similar to FIG. 24, with a wing of the shower partitioning being pivoted outwards.
Figure 26:
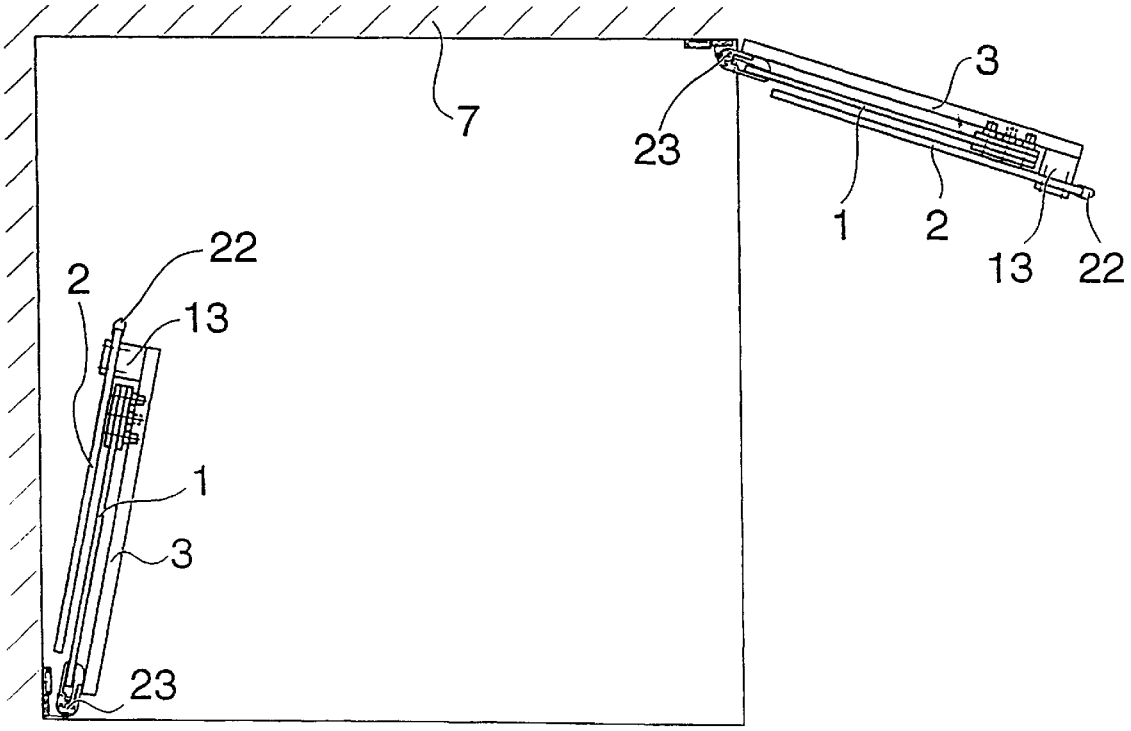
FIG. 26 is a view, similar to FIG. 25, with a wing of the shower partitioning being additionally pivoted inwards.

FIGS. 23 to 26 are a top view showing a situation where a corner shower is provided with two shower partitionings of the invention. FIG. 23 shows the completely closed state. The state shown in FIG. 24 is reached by sliding the second partition panes in the direction of the arrow. It is now possible to pivot the first partition panes either to the outside or to the inside to guarantee free access to the shower tray. The pivoting operation is performed about the rotational axes 23.

Figure 27:
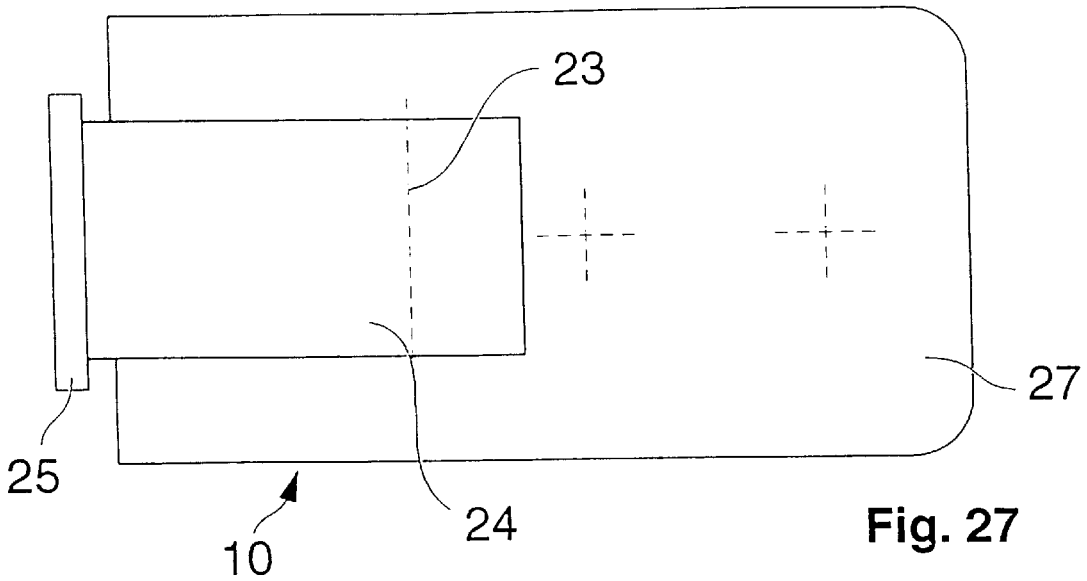
FIG. 27 is a simplified lateral view of a bearing hinge for the first partition pane.
Figure 28:
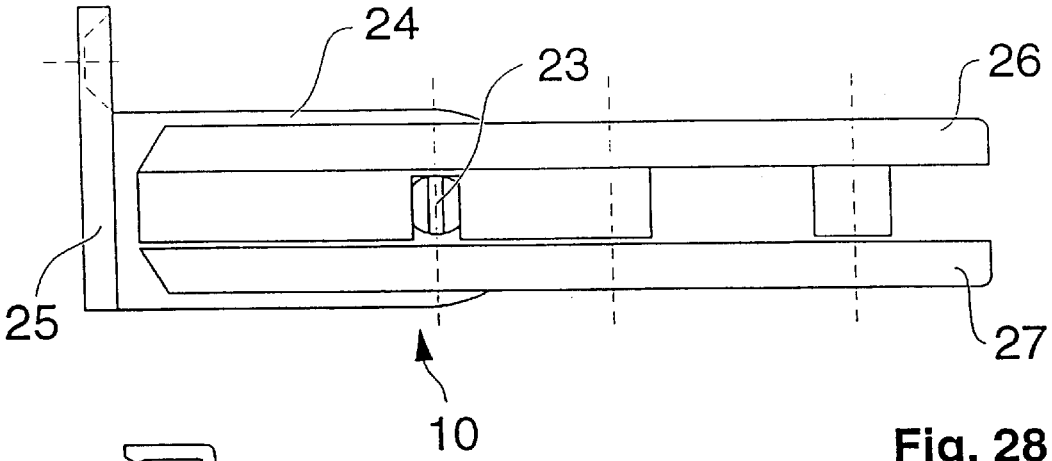
FIG. 28 is a top view on the arrangement according to FIG. 27.

FIGS. 27 and 28 show an embodiment of a hinge joint 10 of the invention. The hinge joint comprises a bearing block 24 which is integrally provided with a fastening plate 25 which, in turn, can be screwed to the wall 7 of the building. Two holding plates 26 and 27 which are screwed to each other and between which a first partition pane 1 (not shown) can be clamped are supported about a rotational axis 23. In this embodiment the hinge joint 10 is designed as a pendulum-type joint.

Figure 4:
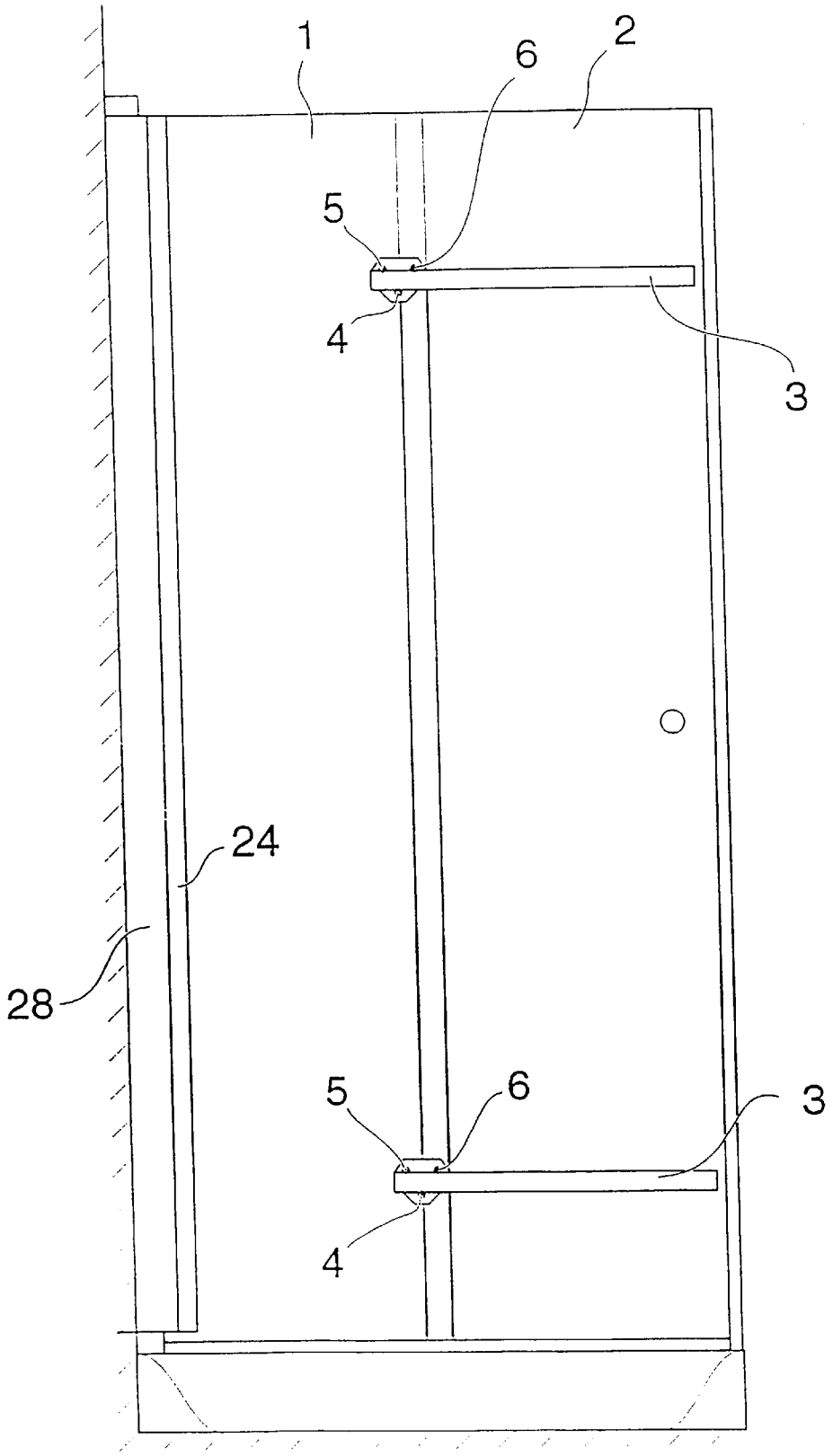
FIG. 4 is a view similar to FIG. 2, showing a different support of the first partition pane.
Figure 29:
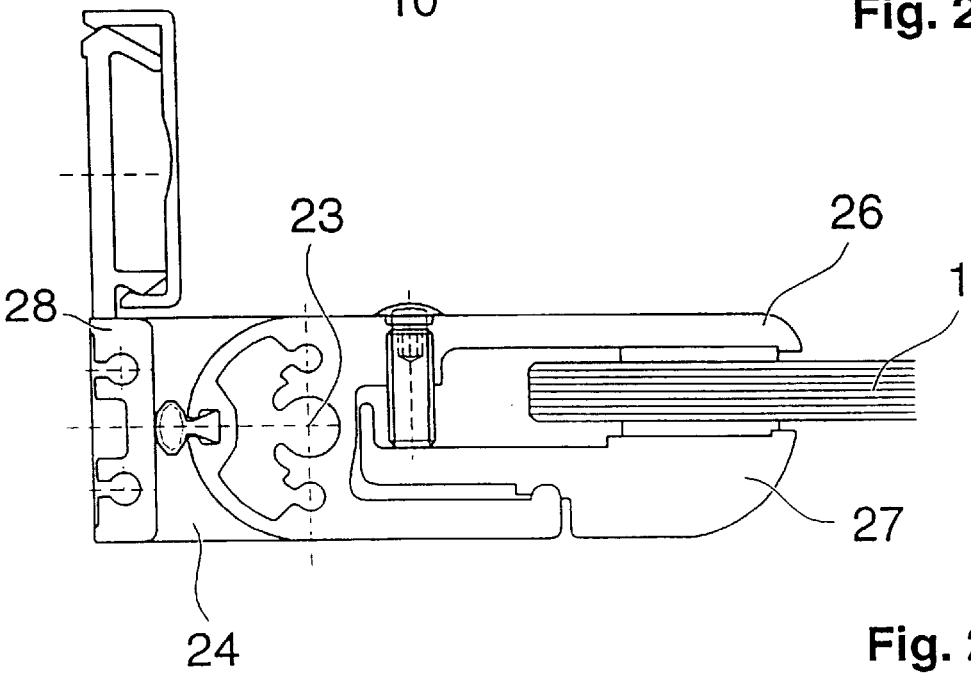
FIG. 29 is a top view, partly in section, of a further embodiment for supporting the first partition pane.

FIG. 29 shows an alternative embodiment in which the bearing block 24 is not mounted on an individual mounting plate 25, but on a continuous rail 28 and is also made continuous (see FIG. 4).

Figure 30:
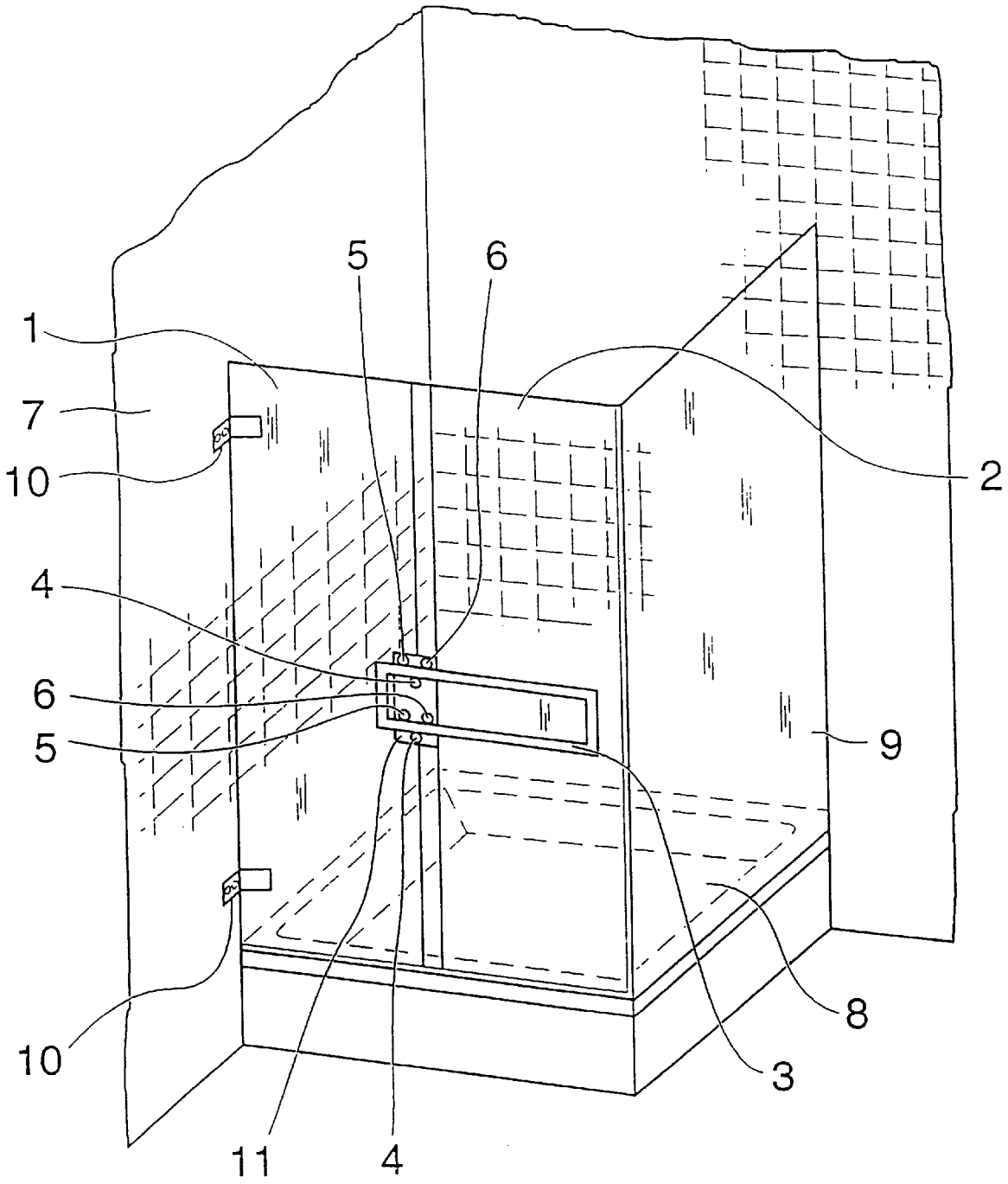
FIG. 30 is a schematic perspective view of a corner-mounted shower, similar to FIG. 1, in which the two carriers are connected to each other in the manner of a frame.
Figure 31:
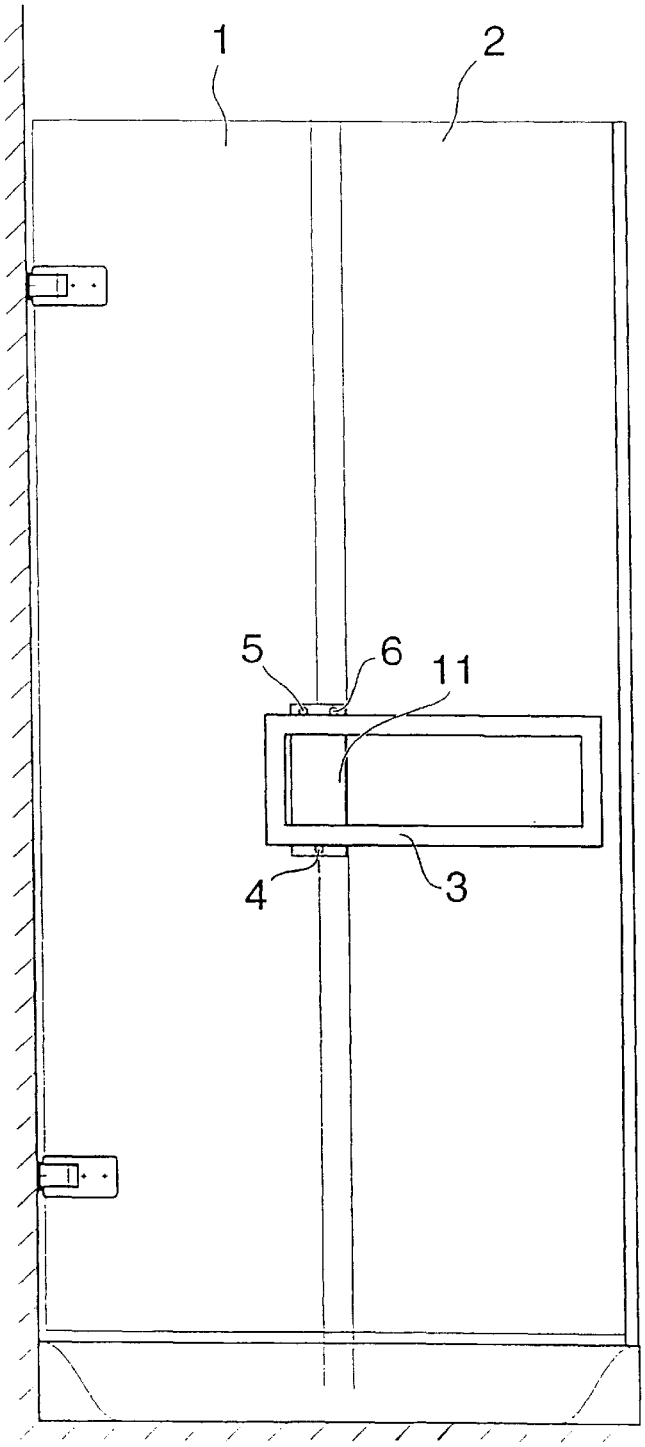
FIG. 31 is a front view, similar to FIG. 2, in a supporting construction which is modified in comparison with the embodiment of FIG. 30.
Figure 32:
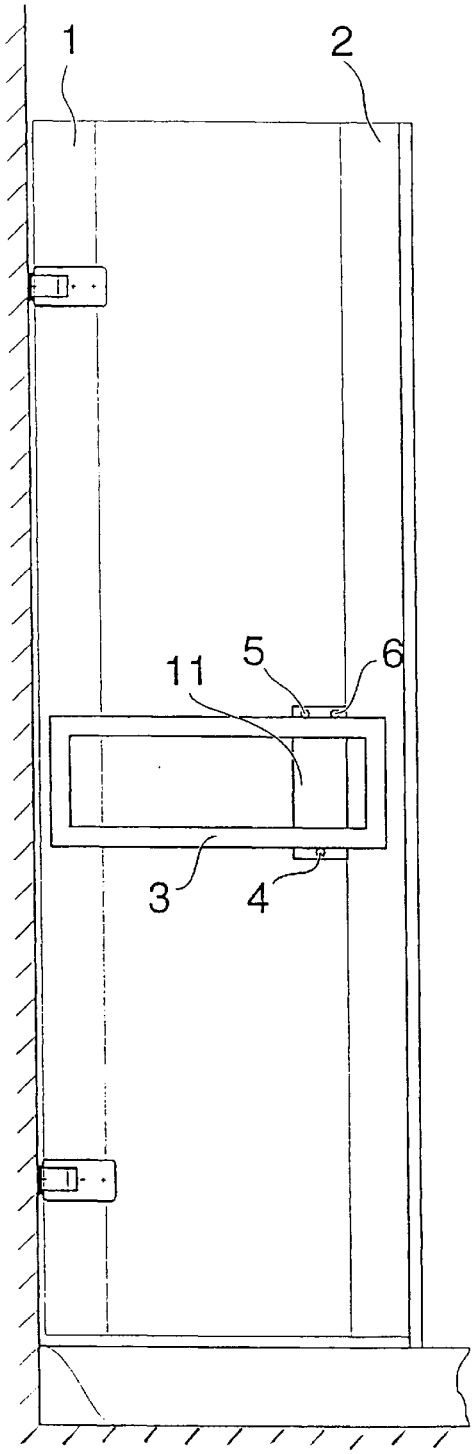
FIG. 32 is a side view, analogous to FIG. 31, in the opened state of the second partition pane.

By analogy with the illustration of FIG. 1, FIG. 30 shows a corner shower. In contrast to the embodiment of FIG. 1, the two carriers 3 are arranged at a small distance from each other, for instance a distance of 15 cm to 20 cm. They are integrally connected to a closed frame. By analogy with the embodiment of FIG. 1, the guide rolls 4, 5 and 6 are respectively assigned to the upper and lower carriers, but all of rolls 4, 5, and 6 are supported on a joint carrier plate.

Figure 39:
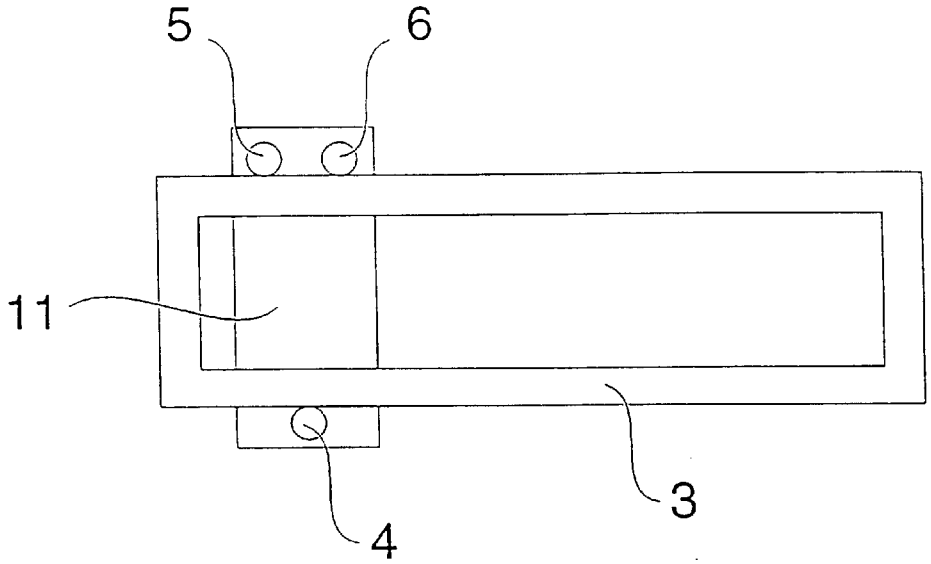
FIG. 39 is a further schematic side view of a carrier according to the invention and of the associated support.

By analogy with FIGS. 2 and 3, FIGS. 31 and 32 show another variant of the invention. In contrast to the embodiment of FIG. 30, in which three guide rolls are provided on the upper carrier and the lower carrier, respectively, the embodiment of FIGS. 31 and 32 only comprises two respective upper guide rolls 5 and 6 and a lower guide roll 4 for the two carriers 3 that are interconnected in the manner of a frame. An enlarged illustration of this construction becomes apparent from FIG. 39. It goes without saying that the horizontal distance of the two guide rolls 5, 6 is variable to prevent the second partition pane from tilting laterally.

Figure 33:
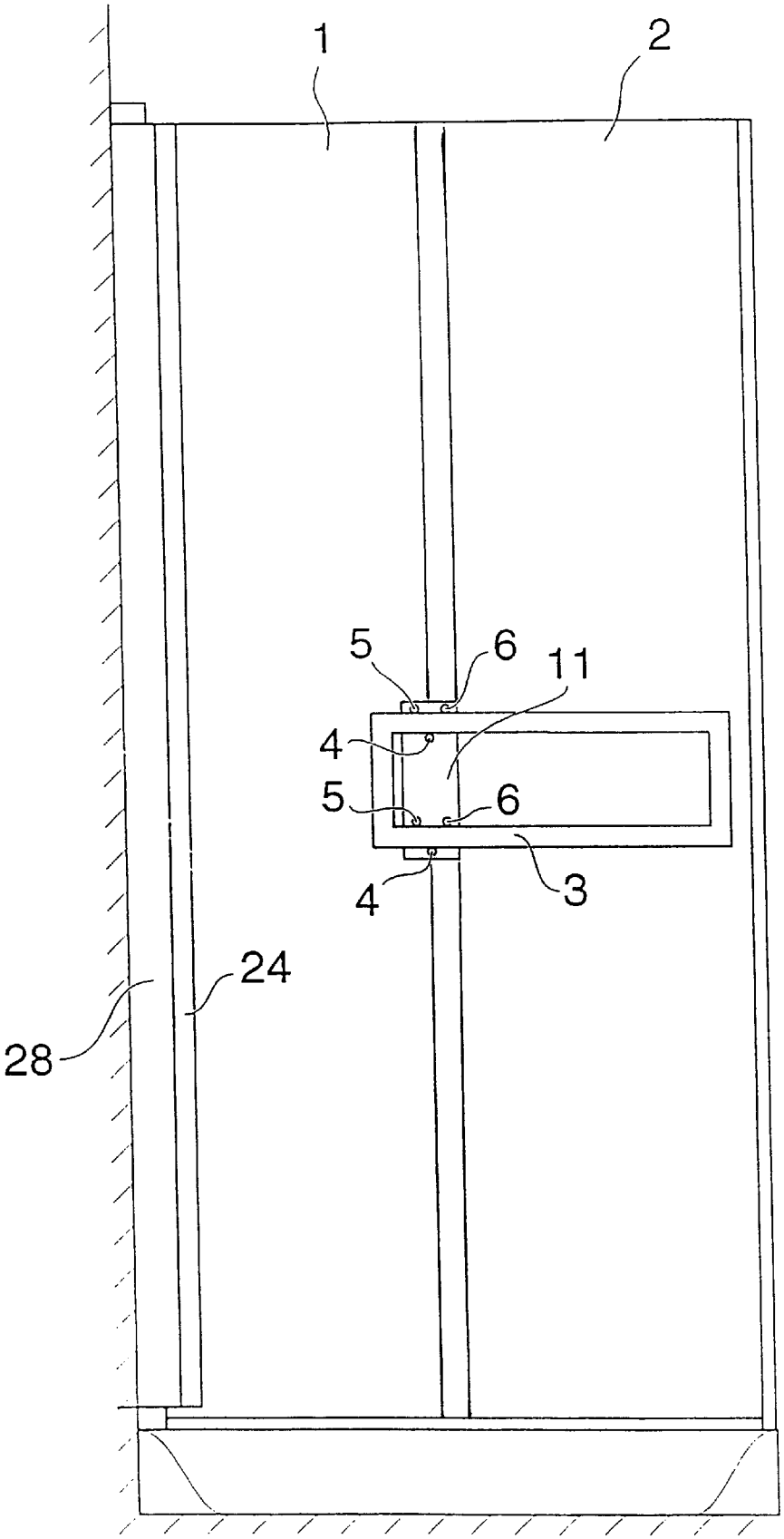
FIG. 33 is a view, similar to FIG. 4, with the first partition pane being supported in a different manner.

The illustration of FIG. 33, which is analogous to FIG. 4, once again shows a carrier construction according to the embodiment of FIG. 30.

Figure 34:
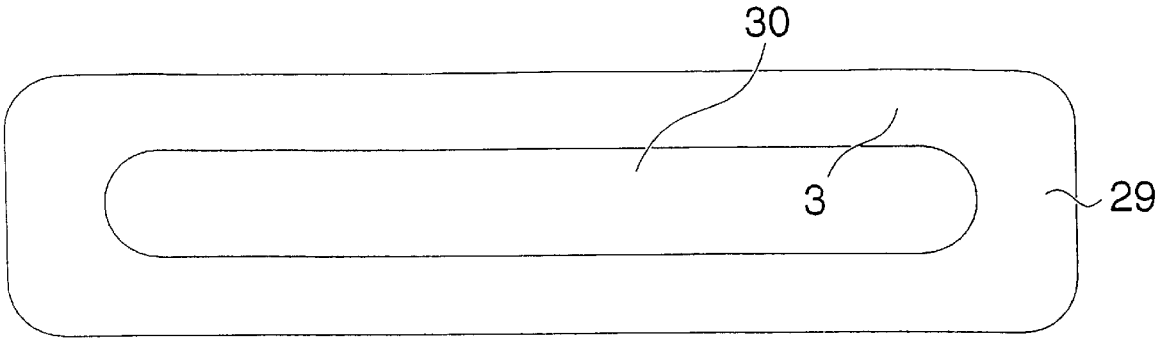
FIG. 34 is a simplified side view of a first embodiment of a double carrier according to the invention.
Figure 35:
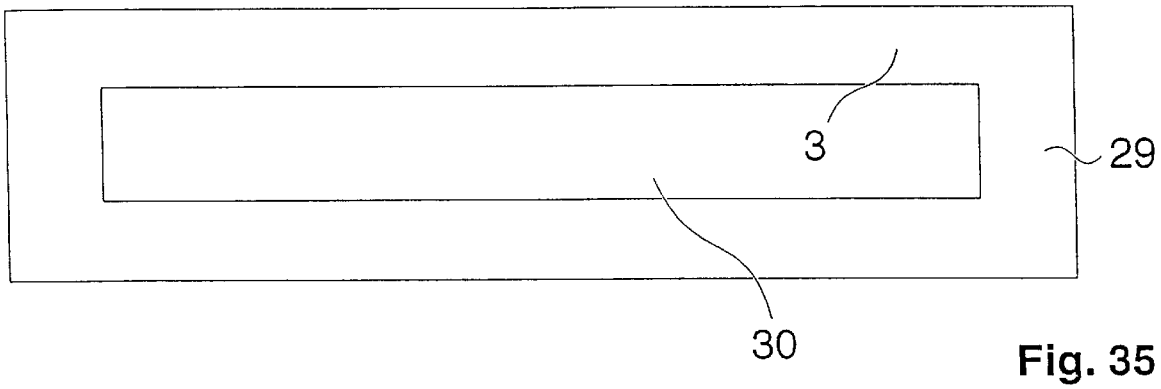
FIG. 35 is a side view of a further embodiment of a double carrier.

Each of FIGS. 34 to 37 shows a variant of the carrier. In FIG. 34 all of the corner portions are provided with generous radii, whereas the embodiment of FIG. 35 shows a rectangular shape. In both types of embodiments, the transition between the upper carrier and the lower carrier forms a grip portion 29; the interior between the two carriers is in the form of a recess 30.

Figure 36:
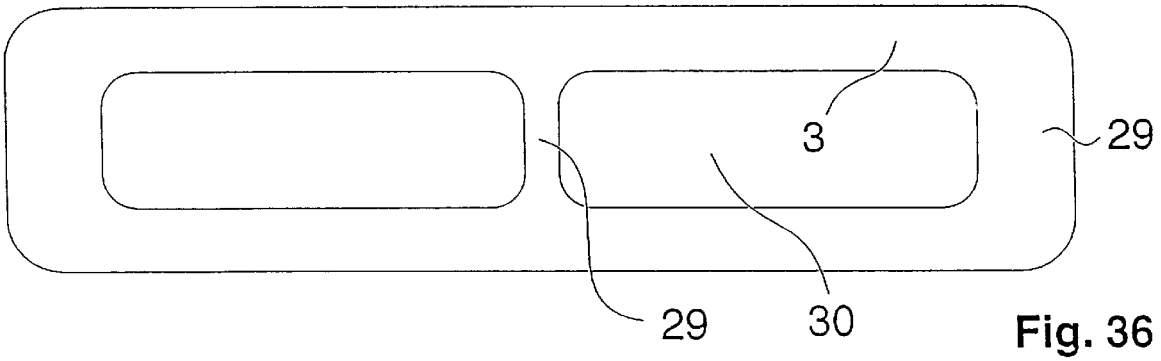
FIG. 36 is a further side view of an embodiment of a double carrier.
Figure 37:
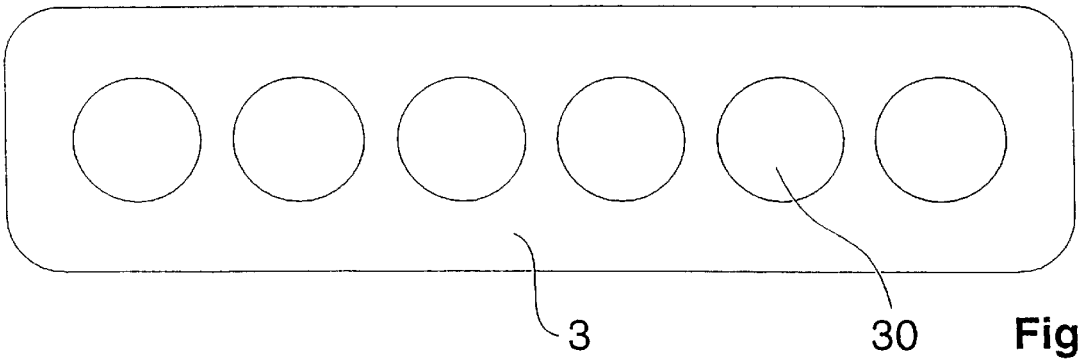
FIG. 37 shows a further possible design for the carrier of the invention.

In the embodiment of FIG. 36, a web is additionally provided and forms an additional grip portion 29. FIG. 37 shows a further embodiment in which a plate-like basic form is used with a plurality of recesses 30.

Figure 13:
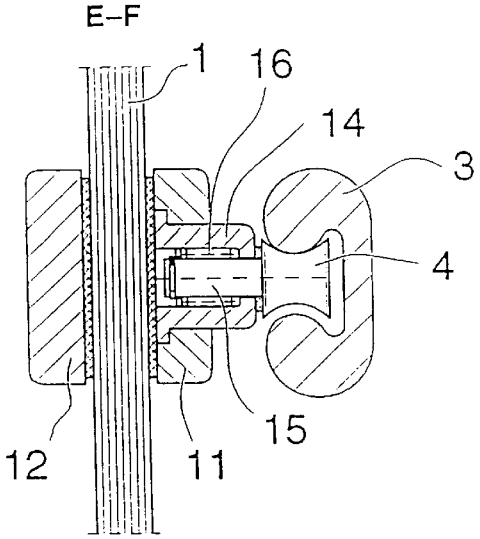
FIG. 13 is a sectional view taken along section line E–F of FIG. 9.
Figure 14:
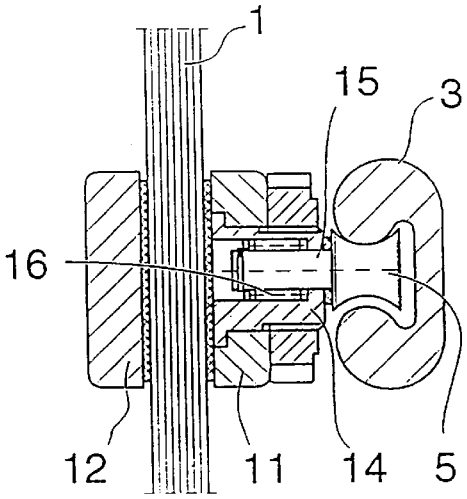
FIG. 14 is a further sectional view of a modified embodiment, similar to the view of FIG. 13.
Figure 38:
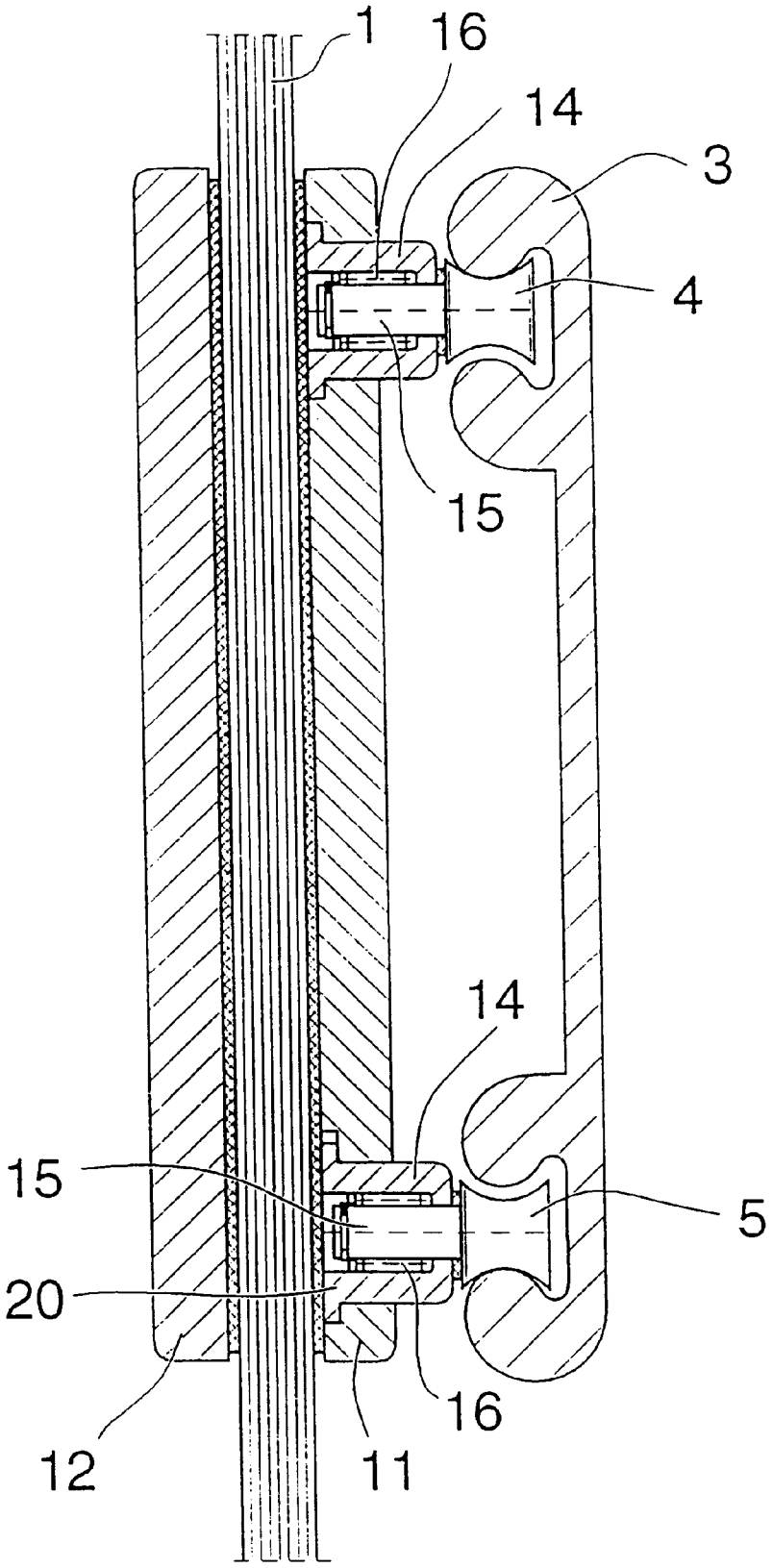
FIG. 38 is a simplified lateral sectional view of a further embodiment of the carrier according to the invention, by analogy with the illustrations shown in FIGS. 11 and 13.

FIG. 38 is a simplified lateral sectional view of a further embodiment of the carrier 3. The carrier 3 engages the guide rolls 4, 5 as shown in FIGS. 11 and 13 which are described above.

Thanks to the above-described possibility, i.e. to form a grip portion 29 in addition, the whole construction of the shower partitioning is simplified, since additional grips need not be provided on the partition panes.

Figure 40:
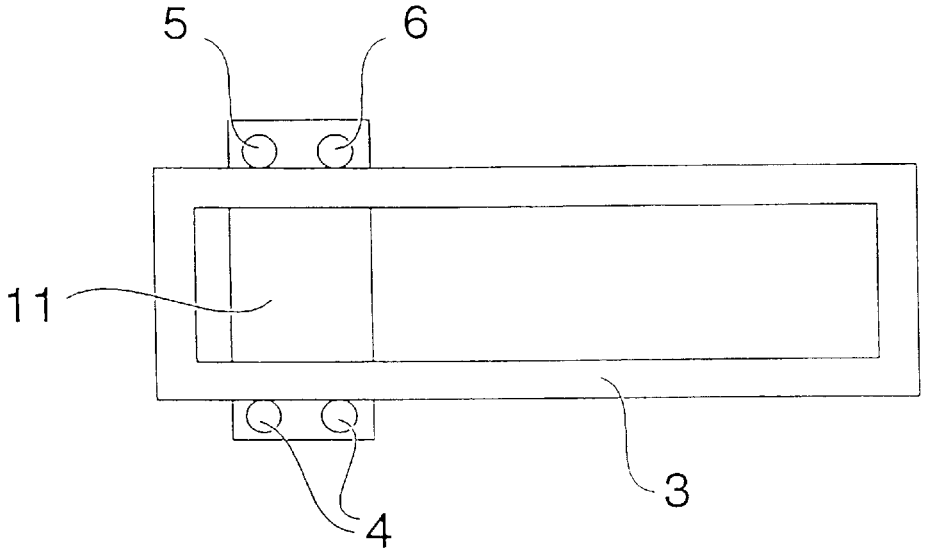
FIG. 40 is a further schematic side view, similar to FIG. 39, of an embodiment of a carrier according to the invention and of the associated support.
Figure 41:
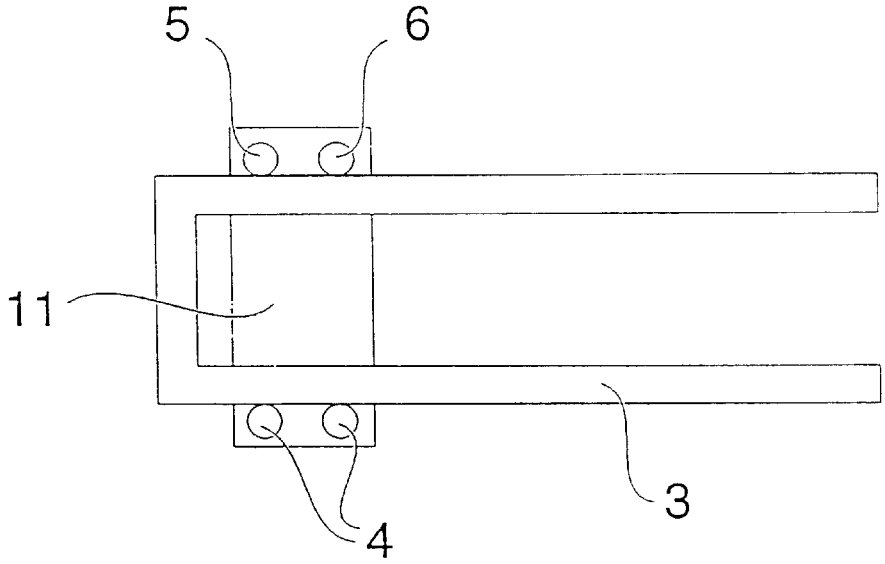
FIG. 41 shows a further embodiment of the carrier, similar to FIG. 40.

FIGS. 40 and 41 are schematic illustrations of two further sides views of a carrier construction according to the invention. In these embodiments, the carrier plate has arranged thereon upper guide rolls 5 and 6, similar to the above-described embodiments. In contrast to said embodiments, however, there are provided two lower rolls 4 which additionally support the lower portion 3 of the horizontal carrier. A high degree of additional stability is achieved in this manner. The height of the frame-like horizontal carrier as shown in FIG. 40 may, for instance, be 80 mm. Even in the case of heavy partition panes or glass doors, it is ensured that these do not tilt or get inclined. Any jamming of the horizontal carrier 3 is thus avoided reliably.

The embodiment of FIG. 41 shows that an end of the horizontal, frame-like carrier 3 may be of an open-type construction. It goes without saying that the U-shaped carrier can also be used when rotated about 180°.

Figure 42:
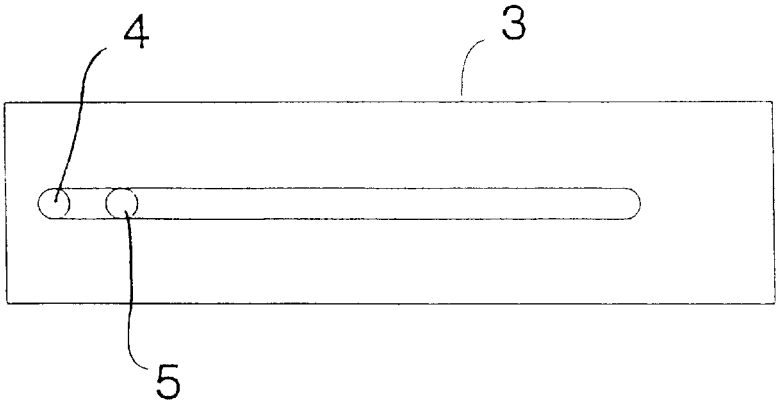
FIG. 42 is a schematic illustration of a further embodiment of a carrier according to the invention.

FIG. 42 shows another embodiment of the carrier 3 of the invention. The carrier is designed as a frame, with the two guide rolls 4 and 5 being arranged in the interior of the carrier 3. The interior may be slitted in its height and dimensioned such that it is only slightly higher than the diameter of the guide rolls 4, 5.

The invention is not restricted to the illustrated embodiments; rather, many variations and modifications are possible within the scope of the present invention. These regard both the dimensions and the design of the carrier, but also slidability and pivotability of both the first partition pane and the second partition pane. The shower partitioning of the invention is thus usable as a sliding door for corner access, as a revolving door or also as a folding door. Hence, the invention can be used in a universal manner for all kinds of showers or baths, with lateral access or corner access. To sum up, the following should be noted:

The present invention relates to a shower partitioning comprising at least one vertically supported frameless first partition pane 1 which has a second partition pane 2 slidably held thereon in a plane parallel to the plane of the first partition pane 1, characterized in that at least one horizontal carrier 3 which is supported on the first partition pane 1 in a longitudinally slidable manner by means of at least two guide rolls 4, 5 is secured to the second partition pane 2 in a plane parallel to the second partition pane 2 and spaced apart from the second partition pane 2.

What is claimed is:

1. A shower partitioning comprising at least one vertically supported, frameless first partition pane which has slidably held thereon a second partition pane in a plane parallel to a plane containing said first partition pane, with at least one horizontal carrier being supported on said first partition pane in a longitudinally slidable manner by means of at least two guide rolls, said at least one horizontal carrier being secured to said second partition pane in a plane parallel to said second partition pane and spaced apart from said second partition pane.

2. A shower partitioning as defined in claim 1, wherein said two guide rolls are rotatable about horizontal axes which are parallel.

3. A shower partitioning as defined in claim 1, wherein said at least two guide rolls comprise a first guide roll horizontally spaced apart from a second guide roll.

4. A shower partitioning as defined in claim 1, wherein at least one guide roll is at least vertically adjustable.

5. A shower partitioning as defined in claim 4, wherein said vertically adjustable guide roll is adjustable by means of an eccentric mechanism.

6. A shower partitioning as defined in claim 1, wherein said guide rolls are provided with means for laterally guiding said carrier.

7. A shower partitioning as defined in claim 6, wherein said guide rolls have a concave shape.

8. A shower partitioning as defined in claim 1, wherein said at least two guide rolls comprise first and second guide rolls, wherein said carrier has a substantially rectangular cross-section and said first guide roll is arranged below said carrier and wherein said second guide roll is arranged above said carrier.

9. A shower partitioning as defined in claim 8, wherein said carrier has an upper side and a lower side each forming a running surface, and wherein the upper and lower sides have a convex shape.

10. A shower partitioning as defined in claim 8, wherein a third guide roll is supported in front of said first guide roll and above said carrier on said first partition pane.

11. A shower partitioning as defined in claim 1, wherein said carrier has a substantially C-shaped cross-section defining an interior volume, and wherein said at least two guide rolls comprise a first guide roll and a second guide roll arranged in the interior volume of said carrier.

12. A shower partitioning as defined in claim 11, wherein a third guide roll is arranged in the interior volume of said carrier.

13. A shower partitioning as defined in claim 1, wherein said carrier and said guide rolls are arranged at the side of said partition panes which faces away from the shower room.

14. A shower partitioning as defined in claim 1, wherein said second partition pane is supported by means of two parallel, spaced-apart carriers and associated guide rolls.

15. A shower partitioning as defined in claim 1, wherein said second partition pane is supported by two parallel upper and lower carriers, which are spaced-apart and integrally interconnected, and associated guide rolls.

16. A shower partitioning as defined in claim 15, wherein said two carriers form a closed frame.

17. A shower partitioning as defined in claim 15, wherein said two carriers form a plate-like element.

18. A shower partitioning as defined in claim 15, wherein a grip portion is formed between said two carriers.

19. A shower partitioning as defined in claim 15, wherein said two carriers are each supported by three guide rolls on a joint carrier plate.

20. A shower partitioning as defined in claim 15, wherein said two carriers are supported on a carrier plate by two guide rolls resting on said upper carrier and by means of a third guide roll resting on said lower carrier.

21. A shower partitioning as defined in claim 1, wherein a stopper is secured to a free end of said carrier.

22. A shower partitioning as defined in claim 21, wherein said stopper is detachably secured.

23. A shower partitioning as defined in claim 1, wherein said rolls are covered by at least one protective cap.

24. A shower partitioning as defined in claim 1, wherein said first partition pane is supported on a wall of a building and is designed as a double-acting door.

25. A shower partitioning as defined in claim 1, wherein said first partition pane is supported on a wall of a building and is designed as a door to be opened at one side.

26. A shower partitioning as defined in claim 1, wherein said first partition pane is supported on a wall of a building.

* * * * *